US010920588B2

(12) United States Patent
Ley et al.

(10) Patent No.: US 10,920,588 B2
(45) Date of Patent: Feb. 16, 2021

(54) ADAPTIVE PITCH STEERING IN A LONGWALL SHEARING SYSTEM

(71) Applicant: Joy Global Underground Mining LLC, Warrendale, PA (US)

(72) Inventors: Jeff Ley, Cranberry, PA (US); Matthew Beilstein, Grove City, PA (US); Colten LeViere, Portersville, PA (US)

(73) Assignee: Joy Global Underground Mining LLC, Warrendale, PA (US)

( * ) Notice: Subject to any disclaimer, the term of this patent is extended or adjusted under 35 U.S.C. 154(b) by 10 days.

(21) Appl. No.: 15/995,998

(22) Filed: Jun. 1, 2018

(65) Prior Publication Data

US 2018/0347357 A1 Dec. 6, 2018

Related U.S. Application Data

(60) Provisional application No. 62/514,010, filed on Jun. 2, 2017.

(51) Int. Cl.
*E21C 35/24* (2006.01)
*E21C 35/12* (2006.01)
(Continued)

(52) U.S. Cl.
CPC ..... *E21C 35/24* (2013.01); *E21C 25/10* (2013.01); *E21C 27/02* (2013.01); *E21C 35/12* (2013.01)

(58) Field of Classification Search
CPC ..... E21C 35/08; E21C 35/12; E21C 35/125; E21C 27/02; E21C 29/02; E21C 35/24
See application file for complete search history.

(56) References Cited

U.S. PATENT DOCUMENTS 3,922,015 A 11/1975 Poundstone
4,008,921 A * 2/1977 Czauderna ..... E21C 35/08 299/1.1
(Continued)

FOREIGN PATENT DOCUMENTS

CN 201433792 3/2010
CN 102061921 5/2011
(Continued)

OTHER PUBLICATIONS

Russian Patent Office Action and Search Report for Application No. 2015134529/03 dated Mar. 21, 2019 (12 pages, English translation included).
(Continued)

*Primary Examiner* — Janine M Kreck
*Assistant Examiner* — Michael A Goodwin
(74) *Attorney, Agent, or Firm* — Michael Best & Friedrich LLP

(57) ABSTRACT

Methods and systems of controlling a pitch angle of a shearer. A controller receives a sensor signal indicative of the pitch angle of the shearer, and receives a target pitch profile defining a plurality of target pitch angles for different sections of a mineral face. The controller determines a pitch difference between the pitch angle and a target pitch angle of the shearer, determines a pitch correction height corresponding to a new height for a floor cutter of the shearer based on the pitch difference, and changes a height of the floor cutter based on the pitch correction height.

14 Claims, 24 Drawing Sheets

(51) Int. Cl.
*E21C 27/02* (2006.01)
*E21C 25/10* (2006.01)

(56) References Cited

U.S. PATENT DOCUMENTS

| | | | | |
|---|---|---|---|---|
| 4,023,861 | A | 5/1977 | Schnell | |
| 4,079,997 | A | 3/1978 | Bienko et al. | |
| 4,143,552 | A | 3/1979 | Godfrey | |
| 4,192,551 | A | 3/1980 | Weimer et al. | |
| 4,200,335 | A | 4/1980 | Moynihan et al. | |
| 4,323,280 | A | 4/1982 | Lansberry et al. | |
| 4,581,712 | A | 4/1986 | Perry et al. | |
| 4,634,186 | A * | 1/1987 | Pease | E21C 35/24 299/1.6 |
| 4,753,484 | A | 6/1988 | Stolarczyk et al. | |
| 4,822,105 | A | 4/1989 | Yamada et al. | |
| 5,228,751 | A * | 7/1993 | Ramsden, Jr. | E21C 35/24 299/1.6 |
| 5,268,683 | A | 12/1993 | Stolarczyk | |
| 5,448,479 | A | 9/1995 | Kemner et al. | |
| 5,469,356 | A | 11/1995 | Hawkins et al. | |
| 5,586,030 | A | 12/1996 | Kemner et al. | |
| 5,615,116 | A | 3/1997 | Gudat et al. | |
| 5,646,845 | A | 7/1997 | Gudat et al. | |
| 5,648,901 | A | 7/1997 | Gudat et al. | |
| 5,838,562 | A | 11/1998 | Gudat et al. | |
| 5,877,723 | A | 3/1999 | Fan | |
| 5,906,646 | A | 5/1999 | Kemner | |
| 5,913,914 | A | 6/1999 | Kemner et al. | |
| 5,925,081 | A | 7/1999 | Hawkins et al. | |
| 5,956,250 | A | 9/1999 | Gudat et al. | |
| 5,961,560 | A | 10/1999 | Kemner | |
| 5,967,616 | A | 10/1999 | Offutt et al. | |
| 6,002,362 | A | 12/1999 | Gudat | |
| 6,132,005 | A | 10/2000 | Mazlin et al. | |
| 6,351,697 | B1 | 2/2002 | Baker | |
| 6,361,119 | B1 | 3/2002 | Kussel | |
| 6,393,362 | B1 | 5/2002 | Burns | |
| 6,442,456 | B2 | 8/2002 | Burns et al. | |
| 6,612,655 | B2 | 9/2003 | Schwoebel et al. | |
| 6,633,800 | B1 | 10/2003 | Ward et al. | |
| 6,666,521 | B1 | 12/2003 | Pease et al. | |
| 6,694,233 | B1 | 2/2004 | Duff et al. | |
| 6,799,100 | B2 | 9/2004 | Burns et al. | |
| 6,857,705 | B2 | 2/2005 | Hainsworth | |
| 7,181,370 | B2 | 2/2007 | Furem et al. | |
| 7,574,821 | B2 | 8/2009 | Furem | |
| 7,578,079 | B2 | 8/2009 | Furem | |
| 7,656,342 | B2 | 2/2010 | Stolarczyk et al. | |
| 7,659,847 | B2 | 2/2010 | Bausov et al. | |
| 7,695,071 | B2 | 4/2010 | Jackson et al. | |
| 7,725,232 | B2 | 5/2010 | Mäkelä et al. | |
| 7,899,599 | B2 | 3/2011 | Mäkelä et al. | |
| 8,157,331 | B2 | 4/2012 | Niederriter et al. | |
| 8,376,467 | B2 | 2/2013 | Junker et al. | |
| 8,562,077 | B2 | 10/2013 | Junker et al. | |
| 8,567,870 | B2 | 10/2013 | Junker et al. | |
| 8,708,421 | B2 | 4/2014 | Junker | |
| 9,506,343 | B2 | 11/2016 | Ley et al. | |
| 9,726,017 | B2 | 8/2017 | Siegrist et al. | |
| 10,082,026 | B2 | 9/2018 | Siegrist et al. | |
| 10,378,356 | B2 | 8/2019 | Siegrist et al. | |
| 2007/0216216 | A1 | 9/2007 | Baird, Jr. et al. | |
| 2009/0134692 | A1 | 5/2009 | Hargrave et al. | |
| 2010/0114808 | A1 | 5/2010 | Mintah | |
| 2010/0138094 | A1 | 6/2010 | Stark et al. | |
| 2010/0276981 | A1 | 11/2010 | Kussel | |
| 2011/0153541 | A1 | 6/2011 | Koch et al. | |
| 2011/0248548 | A1 * | 10/2011 | Junker | E21C 35/125 299/1.6 |
| 2011/0253502 | A1 | 10/2011 | Neilson et al. | |
| 2012/0098325 | A1 | 4/2012 | Junker et al. | |
| 2012/0146387 | A1 | 6/2012 | Shatters | |
| 2012/0170981 | A1 | 7/2012 | Weigel et al. | |
| 2012/0191431 | A1 | 7/2012 | Dunbabin et al. | |
| 2012/0305025 | A1 | 12/2012 | Helbig et al. | |
| 2013/0006484 | A1 | 1/2013 | Avitzur et al. | |
| 2013/0068594 | A1 | 3/2013 | Worthington et al. | |
| 2013/0197737 | A1 | 8/2013 | Shanmugam et al. | |
| 2013/0285573 | A1 | 10/2013 | Paterson | |
| 2015/0056583 | A1 | 2/2015 | Felege et al. | |
| 2016/0061031 | A1 * | 3/2016 | Ley | E21C 27/32 |
| 2016/0061035 | A1 * | 3/2016 | Siegrist | E21F 17/18 340/686.1 |
| 2016/0123145 | A1 * | 5/2016 | Westphalen | E21C 27/32 299/1.6 |

FOREIGN PATENT DOCUMENTS

| | | | | |
|---|---|---|---|---|
| CN | 102102512 | | 6/2011 | |
| CN | 102287186 | | 12/2011 | |
| CN | 102797462 | | 11/2012 | |
| CN | 103728147 | | 4/2014 | |
| CN | 103742142 | | 4/2014 | |
| CN | 103775080 | | 5/2014 | |
| CN | 103835719 | | 6/2014 | |
| DE | 4142165 | | 4/1993 | |
| DE | 4234720 | | 4/1994 | |
| DE | 4439601 | | 5/1996 | |
| GB | 2103265 | | 2/1983 | |
| PL | 394472 | | 10/2012 | |
| RU | 2360111 | | 6/2009 | |
| SU | 1523661 | A1 | 11/1989 | |
| WO | WO9624753 | | 8/1996 | |
| WO | WO-2010037491 | A1 * | 4/2010 | E21C 35/00 |

OTHER PUBLICATIONS

Jaszczsuk et al., "Integrated System for Control and Visualization of Longwall Machinery", Aachen International Mining Symposia, Jun. 2009.

Marewski et al. "From Shendong to Bowen Basin—Longwall Shearer for Thick Seam Mining", Aachen International Mining Symposia, Jun. 2009.

CSIRO Exploration and Mining Report, "Interconnection of Landmark Compliant Longwall Mining Equipment—Shearer Communication and Functional Specification for Enhanced Horizon Control", Dec. 2005.

Douglas, Stephen, "Application of Shearer Automation", 2013 Longwall US Conference, Jun. 2013.

Polish Patent Office Action for Application No. P-413691 dated Apr. 11, 2019 (3 pages including statement of relevance).

International Search Report with Written Opinion for related Application No. PCT/US2018/035652 dated Aug. 31, 2018 (14 pages).

Search Report from the United Kingdom Intellectual Property Office for Application No. GB1514307.6 dated Jan. 22, 2016 (3 pages).

Search Report from the Polish Patent Office for Application No. P-413691 dated Mar. 15, 2016 (2 pages).

Search Report from the Polish Patent Office for Application No. P-413683 dated Mar. 16, 2016 (2 pages).

Corrected Search Report from the British Patent Office for Application No. GB1514307.6 dated Feb. 18, 2016 (2 pages).

First Chinese Office Action for Application No. 2015105418920 dated May 3, 2018 (14 pages including Statement of Relevance).

First Chinese Office Action for Application No. 201510531561.9 dated Jun. 28, 2018 (12 pages including Statement of Relevance).

Australian Examination Report for related Application No. 2015210478 dated Sep. 26, 2018 (3 pages).

United States Patent Office Action Non Final Rejection for related U.S. Appl. No. 16/456,819 dated Oct. 16, 2019 (7 pages).

United States Patent Office Action for U.S. Appl. No. 14/839,599 dated Oct. 6, 2016 (8 pages).

United States Patent Office Action for U.S. Appl. No. 15/651,422 dated Jan. 31, 2018 (7 pages).

United States Patent Office Action for related U.S. Appl. No. 16/107,688 dated Oct. 4, 2018 (7 pages).

* cited by examiner

ADAPTIVE PITCH STEERING IN A LONGWALL SHEARING SYSTEM

RELATED APPLICATIONS

This application claims priority to U.S. Provisional Patent Application No. 62/514,010, filed on Jun. 2, 2017, the entire contents of which are hereby incorporated by reference.

FIELD OF INVENTION

The present invention relates to monitoring and controlling the cutting drums of a longwall shearer to achieve a desired angle of advancement. This angle of advancement is referred to as the "pitch" angle within this application.

SUMMARY

In one embodiment, a method of controlling a pitch angle of a shearer is provided. The method includes receiving a sensor signal indicative of the pitch angle of the shearer, and receiving a target pitch profile defining a plurality of target pitch angles for different sections of a mineral face. The method also includes determining a pitch difference between the pitch angle and a target pitch angle of the shearer, determining a pitch correction height corresponding to a new height for a floor cutter of the shearer based on the pitch difference, and changing a height of the floor cutter based on the pitch correction height. In some embodiments, a controller including an electronic processor and a memory implement the method of controlling a pitch angle of a shearer.

In some embodiments, the method also includes receiving a pitch compensation value, and wherein determining the pitch correction height includes determining the pitch correction height based on the pitch difference and the pitch compensation value.

In another embodiment, a system of controlling a pitch angle of a shearer is provided. The system includes a shearer sensor configured to sense a position characteristic of the shearer, a floor cutter driven by a cutter motor, and a controller coupled to the shearer sensor and the cutter motor. The controller includes an electronic processor and a memory. The electronic processor is configured to receive a sensor signal from the shearer sensor indicative of the pitch angle of the shearer, and receive a target pitch profile defining a plurality of target pitch angles for different sections of a mineral face. The electronic processor is further configured to determine a pitch difference between the pitch angle and a target pitch angle of the plurality of target pitch angles of the target pitch profile, and to determine a pitch correction height corresponding to a new height for a floor cutter of the shearer based on the pitch difference. The electronic processor then changes a height of the floor cutter based on the pitch correction height.

In another embodiment, a method of generating a target pitch profile for a shearer is provided. The method includes receiving a nominal pitch profile for the shearer, accessing correction offsets input by an external source, and setting target pitch angles of the target pitch profile based on both the nominal pitch profile and the correction offsets. The method also includes controlling a position of a floor cutter based on the target pitch profile.

In some embodiments, receiving the nominal pitch profile for the shearer includes receiving the nominal pitch profile for the shearer in response to a selection from an operator of the shearer. In some embodiments, the nominal pitch profile for the shearer includes an array that defines nominal pitch angles for a length of a mineral face. In some embodiments, the nominal pitch profile for the shearer includes an array having a length equal to a number of pans in a longwall system and that specifies a nominal pitch angle for each pan. In some embodiments, the nominal pitch profile for the shearer includes an array with a length that is less than a number of pans in a longwall system.

In some embodiments, accessing the correction offsets includes accessing a correction offset pass count that indicates a number of passes for which the correction offset is to be implemented. In some embodiments, after the number of passes, target pitch angles of the target pitch profile modified by the correction offsets are set to corresponding pitch angles of the nominal pitch profile.

In some embodiments, the method also includes generating the nominal pitch profile based on historical information regarding previously implemented correction offsets.

In some embodiments, a controller including an electronic processor and a memory implement the method of generating a nominal pitch profile for a shearer. The controller may be incorporated into a shearer and in communication with shearer sensors and the floor cutter.

In another embodiment, a method of controlling a pitch angle of a shearer is provided. The method includes receiving a target pitch profile for the shearer, receiving a sensor signal indicative of the pitch angle of the shearer during a first pass of the shearer, controlling a height of a floor cutter of the shearer based on the target pitch profile during the first pass of the shearer. The method also includes receiving a correction offset for the shearer during a second pass of the shearer, changing the height of the floor cutter of the shearer based on the correction offset during the second pass of the shearer, and changing the height of the floor cutter of the shearer based on the target pitch profile on the third pass of the shearer. In some embodiments, a controller including an electronic processor and a memory implement the method of controlling a pitch angle of a shearer. The controller may be incorporated into a shearer and in communication with shearer sensors and the floor cutter.

Other aspects of the invention will become apparent by consideration of the detailed description and accompanying drawings.

DETAILED DESCRIPTION

Figure 1:
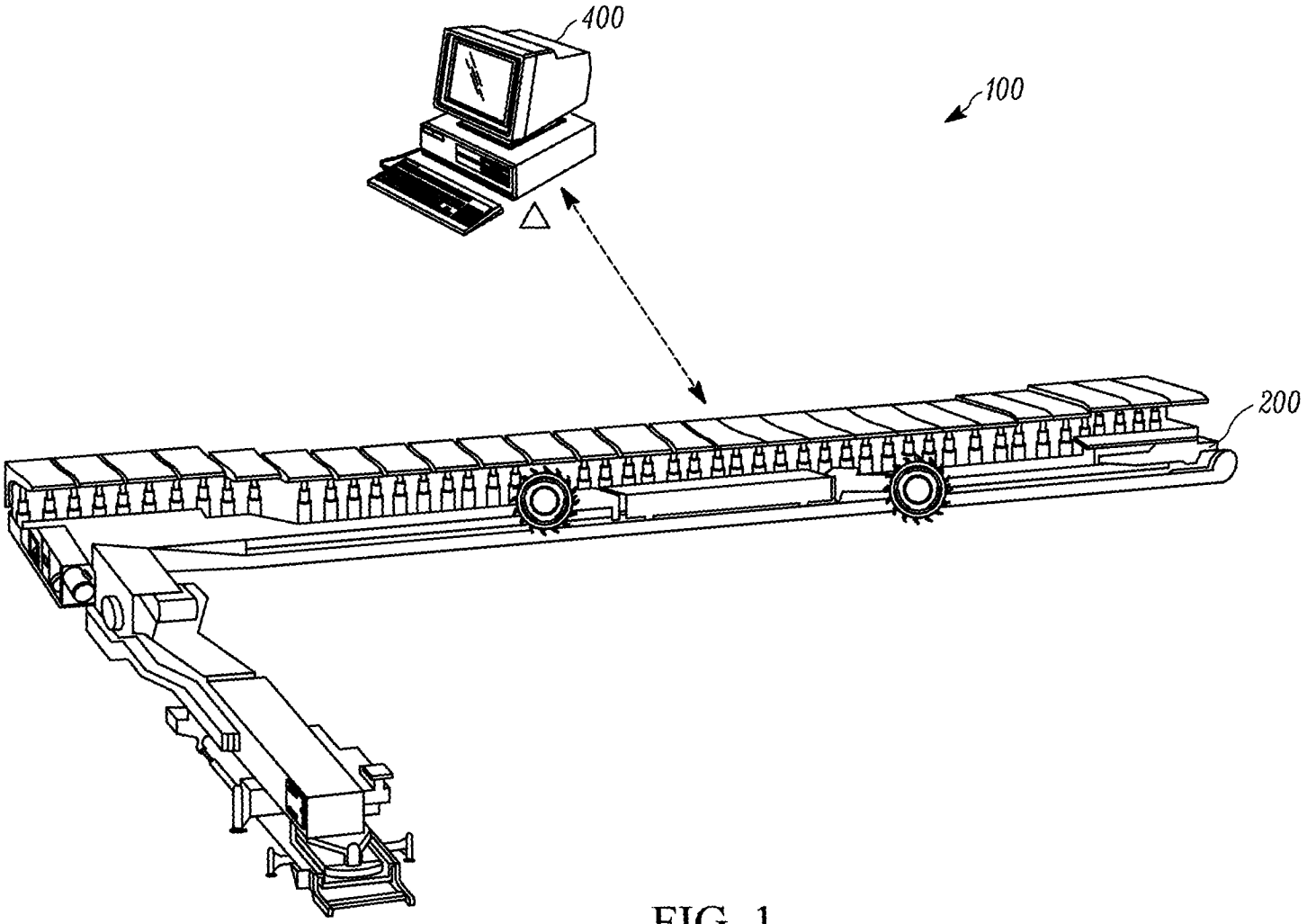
FIG. 1 is a schematic diagram of an extraction system according to one embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

In addition, it should be understood that embodiments of the invention may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software (e.g., stored on non-transitory computer-readable medium) executable by one or more processors. As such, a plurality of hardware and software based devices, as well as a plurality of different structural components, may be utilized to implement the invention. Furthermore, and as described in subsequent paragraphs, the specific mechanical configurations illustrated in the drawings are intended to exemplify embodiments of the invention. However, other alternative mechanical configurations are possible. For example, "controllers" and "modules" described in the specification can include one or more processors, one or more computer-readable medium modules, one or more input/output interfaces, and various connections (e.g., a system bus) connecting the components. In some instances, the controllers and modules may be implemented as or by one or more of general purpose processors, digital signal processors DSPs), application specific integrated circuits (ASICs), and field programmable gate arrays (FPGAs) that execute instructions or otherwise implement their functions described herein.

FIG. 1 illustrates an extraction system 100. The extraction system 100 includes a longwall mining system 200 and a health monitoring system 400. The extraction system 100 is configured to extract an ore or a mineral, for example, coal from a mine in an efficient manner. In other embodiments, the extraction system 100 is used to extract other ores and/or minerals. For example, in some embodiments, Trona, a non-marine evaporate mineral, is extracted using a longwall mining system. The longwall mining system 200 includes tools, for example, a shearer 300, to physically extract coal, or another mineral, from an underground mine. The health monitoring system 400 monitors operation of the longwall mining system 200 to, for example, ensure that extraction of the mineral remains efficient, detect equipment problems, and the like.

Longwall mining begins with identifying a mineral seam to be extracted, then "blocking out" the seam into mineral panels by excavating roadways around the perimeter of each panel. During excavation of the seam (i.e., extraction of coal), select pillars of mineral can be left unexcavated between adjacent mineral panels to assist in supporting the overlying geological strata. The mineral panels are excavated by the longwall mining system 200, and the extracted mineral is transported to the surface of the mine.

Figure 2A:
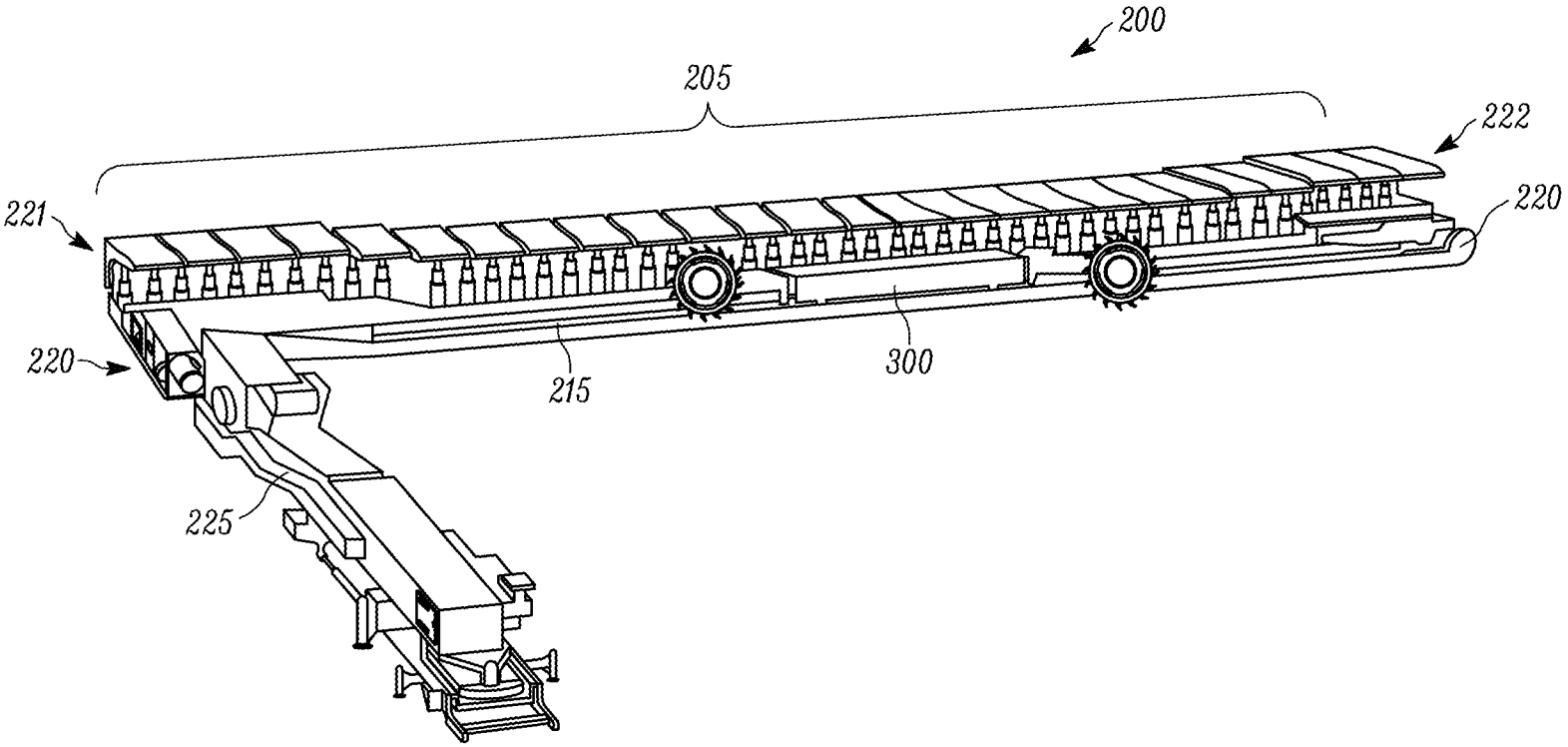
FIGS. 2A-B illustrate a longwall mining system of the extraction system of FIG. 1.
Figure 2B:
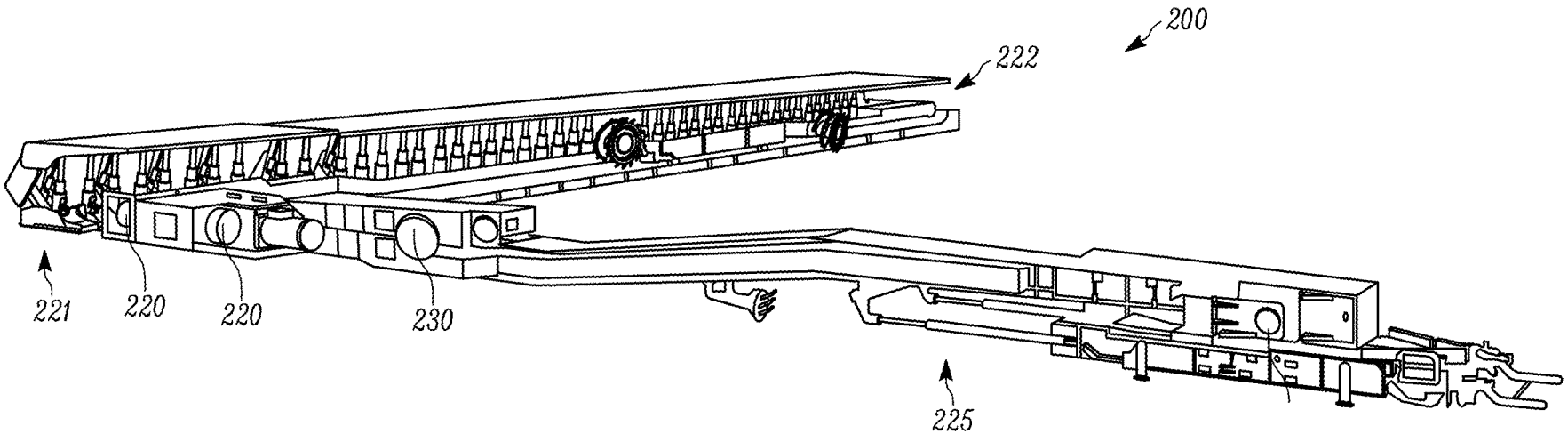

As illustrated in FIGS. 2A-2B, the longwall mining system 200 includes roof supports 205, a longwall shearer 300, and an armored face conveyor (AFC) 215. The longwall mining system 200 is generally positioned parallel to the mineral face 216 (see FIG. 3). The roof supports 205 are interconnected parallel to the mineral face 216 (see FIG. 3) by electrical and hydraulic connections. Further, the roof supports 205 shield the shearer 300 from overlying geological strata 218 (see FIG. 3). The number of roof supports 205 used in the mining system 200 depends on the width of the mineral face 216 being mined since the roof supports 205 are intended to protect the full width of the mineral face 216 from the strata 218.

The shearer 300 is propagated along the line of the mineral face 216 by the AFC 215, which includes a dedicated track for the shearer 300 running parallel to the mineral face 216. The shearer track is positioned between the mineral face 216 itself and the roof supports 205. As the shearer 300 travels the width of the mineral face 216, removing a layer of mineral, the roof supports 205 automatically advance to support the roof of the newly exposed section of strata 218.

Figure 3:
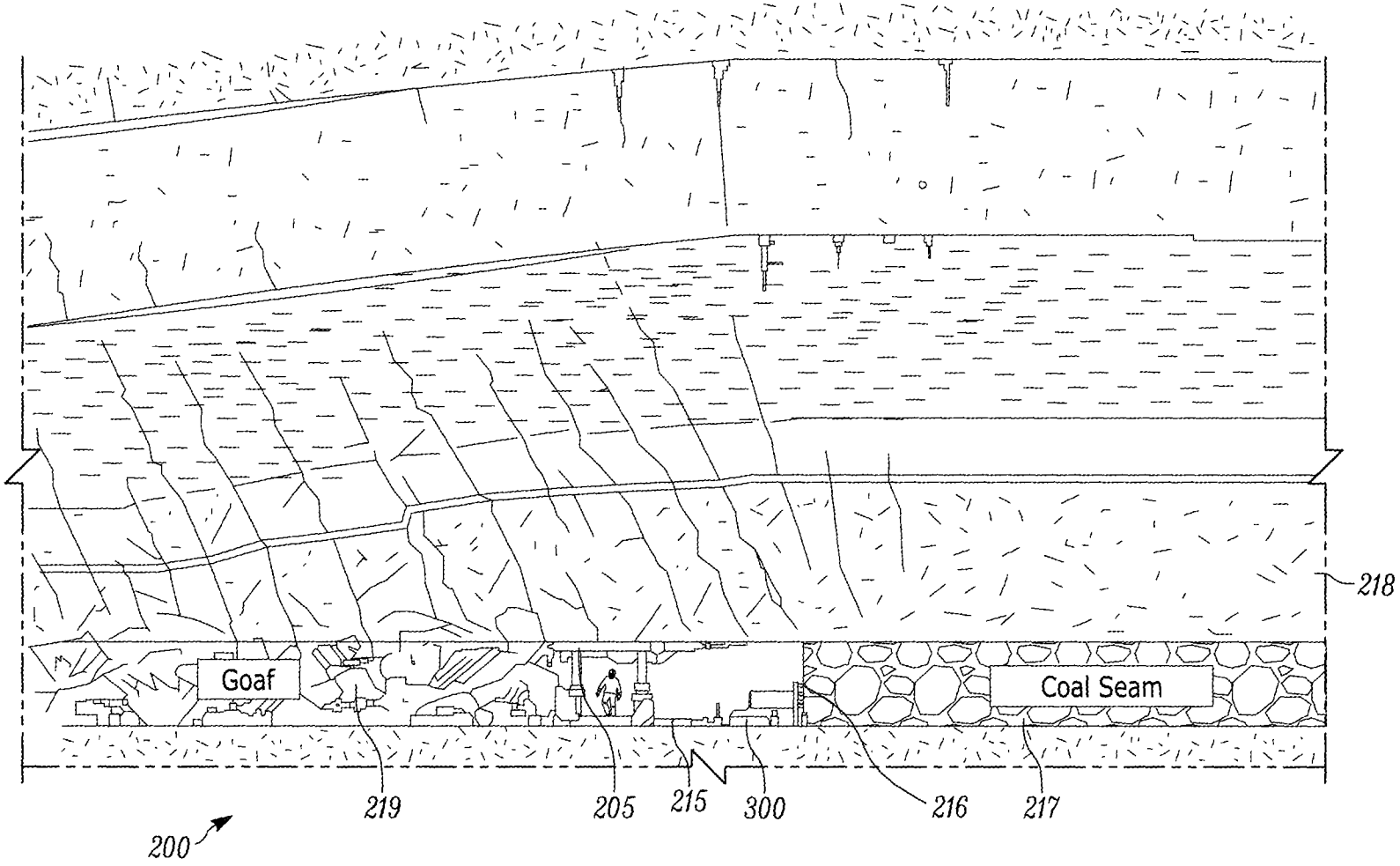
FIG. 3 illustrates collapsing of the geological strata as mineral is removed from the mineral seam.

FIG. 3 illustrates the mining system 200 advancing through the mineral seam 217 as the shearer 300 removes mineral from the mineral face 216. The mineral face 216 illustrated in FIG. 3 extends perpendicular from the plane of the figure. As the mining system 200 advances through the mineral seam 217 (to the right in FIG. 3), the strata 218 is allowed to collapse behind the mining system 200, forming a goaf 219. The mining system 200 continues to advance forward and shear more mineral until the end of the mineral seam 217 is reached.

While the shearer 300 travels along the side of the mineral face 216, extracted mineral falls onto a conveyor included in the AFC 215, parallel to the shearer track. The mineral is transported away from the mineral face 216 by the conveyor. The AFC 215 is then advanced by the roof supports 205 toward the mineral face 216 by a distance equal to the depth of the mineral layer previously removed by the shearer 300. The advancement of the AFC 215 allows the excavated mineral from the next shearer pass to fall onto the conveyor, and also allows the shearer 300 to engage with the mineral face 216 and continue shearing mineral away. The conveyor and track of the AFC 215 are driven by AFC drives 220 located at a maingate 221 and a tailgate 222, which are at distal ends of the AFC 215. The AFC drives 220 allow the conveyor to continuously transport mineral toward the maingate 221 (left side of FIG. 2A), and allows the shearer 300 to be pulled along the track of the AFC 215 bi-directionally across the mineral face 216.

The longwall mining system 200 also includes a beam stage loader (BSL) 225 arranged perpendicularly at the maingate end of the AFC 215. FIG. 2B illustrates a perspective view of the longwall mining system 200 and an expanded view of the BSL 225. When the extracted mineral hauled by the AFC 215 reaches the maingate 221, the mineral is routed through a 90° turn onto the BSL 225. In some instances, the BSL 225 interfaces with the AFC 215 at a non-right 90° angle. The BSL 225 then prepares and loads the mineral onto a maingate conveyor (not shown) which transports the mineral to the surface. The mineral is prepared to be loaded by a crusher 230, which breaks down the mineral to improve loading onto the maingate conveyor. Similar to the conveyor of the AFC 215, the conveyor of the BSL 225 is driven by a BSL drive.

Figure 4:
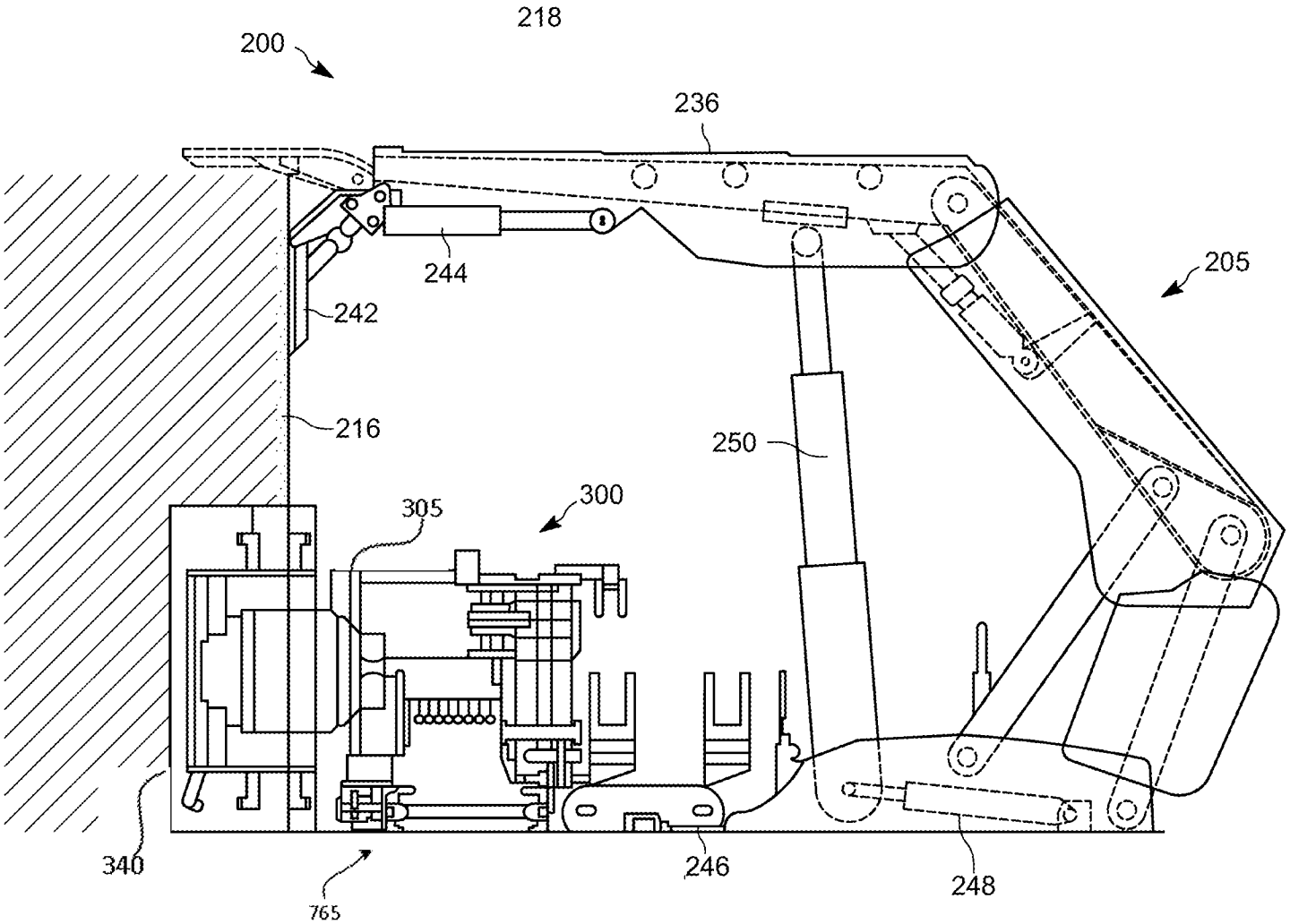
FIG. 4 illustrates a powered roof support of the longwall mining system.
Figure 5:
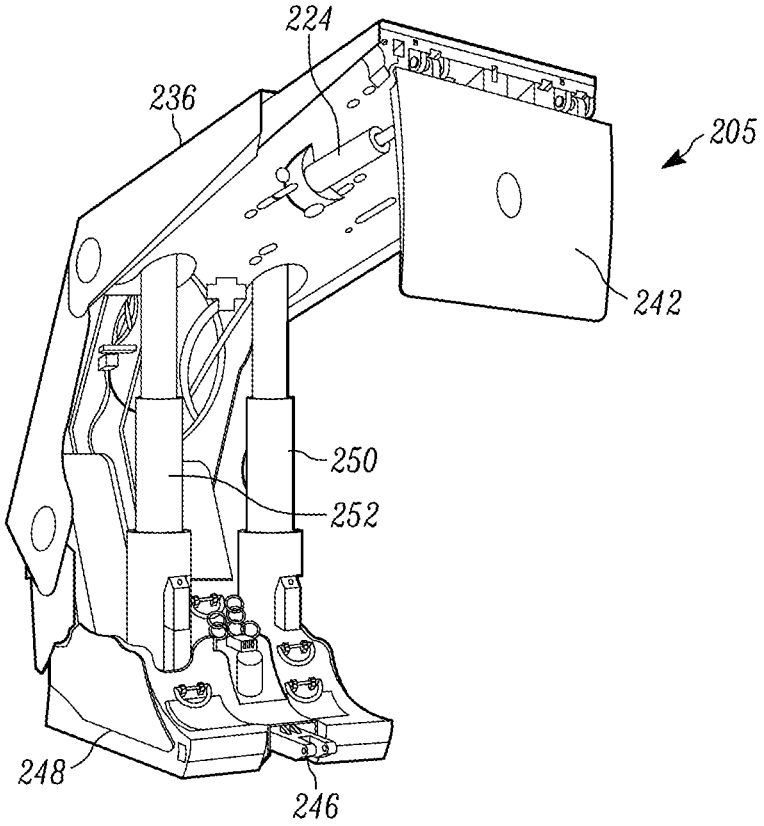
FIG. 5 illustrates another view of the roof support of the longwall mining system.

FIG. 4 illustrates the longwall mining system 200 as viewed along the line of the mineral face 216. The roof support 205 is shown shielding the shearer 300 from the overlying strata 218 by an overhanging canopy 236 of the roof support 205. The canopy 236 is vertically displaced (i.e., moved toward and away from the strata 218) by hydraulic legs 250, 252 (only one of which is shown in FIG. 4). The canopy 236 thereby exerts a range of upward forces on the geological strata 218 by applying different pressures to the hydraulic legs 250, 252. Mounted to the face end of the canopy 236 is a deflector or sprag 242, which is shown in a face-supporting position. However, the sprag 242 can also be fully extended, as shown in ghost, by a sprag arm 244. An advance ram 246 attached to a base 248 allows the roof support 205 to be pulled toward the mineral face 216 as the layers of mineral are sheared away. FIG. 5 illustrates another view of the roof support 205. FIG. 5 shows a left hydraulic leg 250 and a right hydraulic leg 252, which support the canopy 236. Both the left hydraulic leg 250 and the right hydraulic leg 252 contain pressurized fluid to support the canopy 236.

Figure 6A:
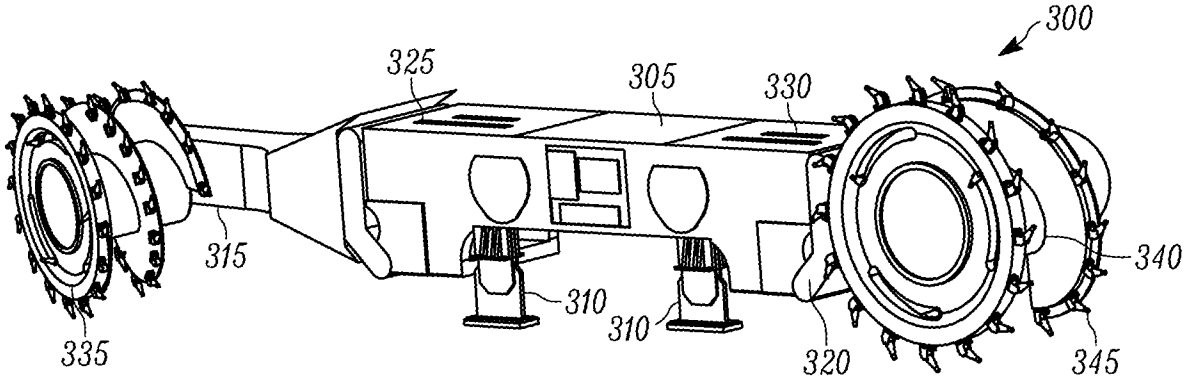
FIGS. 6A-B illustrate a longwall shearer of the longwall mining system.
Figure 6B:
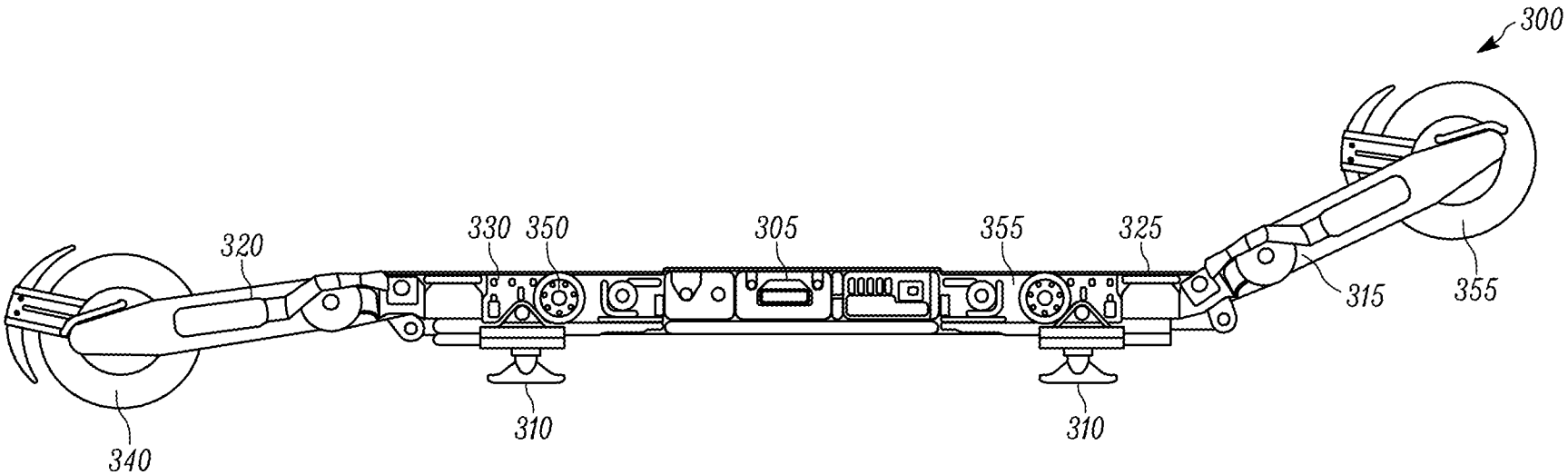

FIGS. 6A-6B illustrate the shearer 300. FIG. 6A illustrates a perspective view of the shearer 300. The shearer 300 has an elongated central housing 305 that stores the operating controls for the shearer 300. Extending below the housing 305 are skid shoes 310 that support the shearer 300 on the AFC 215. In particular, the skid shoes 310 engage the track of the AFC 215 allowing the shearer 300 to be propagated along the mineral face 216. Extending laterally from the housing 305 are left and right cutter arms 320, 315, respectively, which are movably driven by hydraulic cylinders enclosed within a right arm motor housing 325 and a left arm motor housing 330. The hydraulic cylinders are part of a right arm hydraulic system 386 configured to articulate the right cutter arm 315, and a left arm hydraulic system 388 configured to articulate the left cutter arm 320.

On the distal end of the right cutter arm 315 (with respect to the housing 305) is a right cutter 335, and on the distal end of the left cutter arm 320 is a left cutter 340. Each of the cutters 335, 340 has a plurality of mining bits 345 that abrade the mineral face 216 as the cutters 335, 340 rotate, thereby cutting away the mineral. The mining bits 345 can also spray fluid from their tips, such as, for example, for dispersing noxious and/or combustible gases that develop at the excavation site. The right cutter 335 is driven (e.g., rotated) by a right cutter motor 355 while the left cutter 340 is driven (e.g., rotated) by a left cutter motor 350. The hydraulic systems 386, 388 are configured to vertically move the right cutter arm 315 and the left cutter arm 320, respectively, which changes the vertical position of the right cutter 335 and the left cutter 340, respectively.

The vertical positions of the cutters 335, 340 are a function of the angle of the arms 315, 320 with respect to the main housing 305. Varying the angle of the cutter arms 315, 320 with respect to the main housing 305 increases or decreases the vertical position of the cutters 335, 340 accordingly. For example, when the left cutter arm 320 is raised to 20° from the horizontal, the cutter 340 may experience a positive change of vertical position of, for example, 0.5 m, while when the left cutter arm 320 is lowered to −20° from the horizontal, the left cutter 340 may experience a negative change of vertical position of, for example, −0.5 m. Therefore, the vertical position of the cutters 335, 340 may be measured and controlled based on the angle of the cutter arms 315, 320 with respect to the horizontal. FIG. 6B illustrates a side view of the shearer 300 including the cutters 335, 340; cutter arms 315, 320; skid shoes 310, and housing 305. FIG. 6B also shows detail of a left arm motor 350 and right arm motor 355, which are enclosed by the left arm motor housing 330 and right arm motor housing 325, respectively.

Figure 7A:
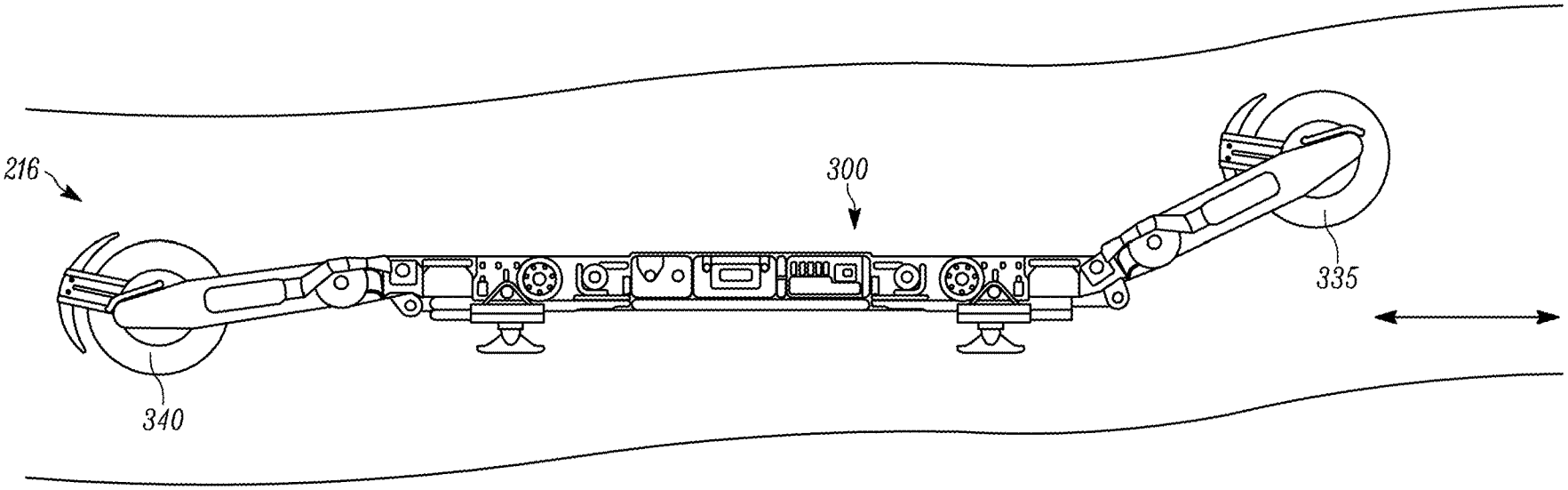
FIGS. 7A-B illustrate a longwall shearer as it passes through a coal seam.
Figure 7B:
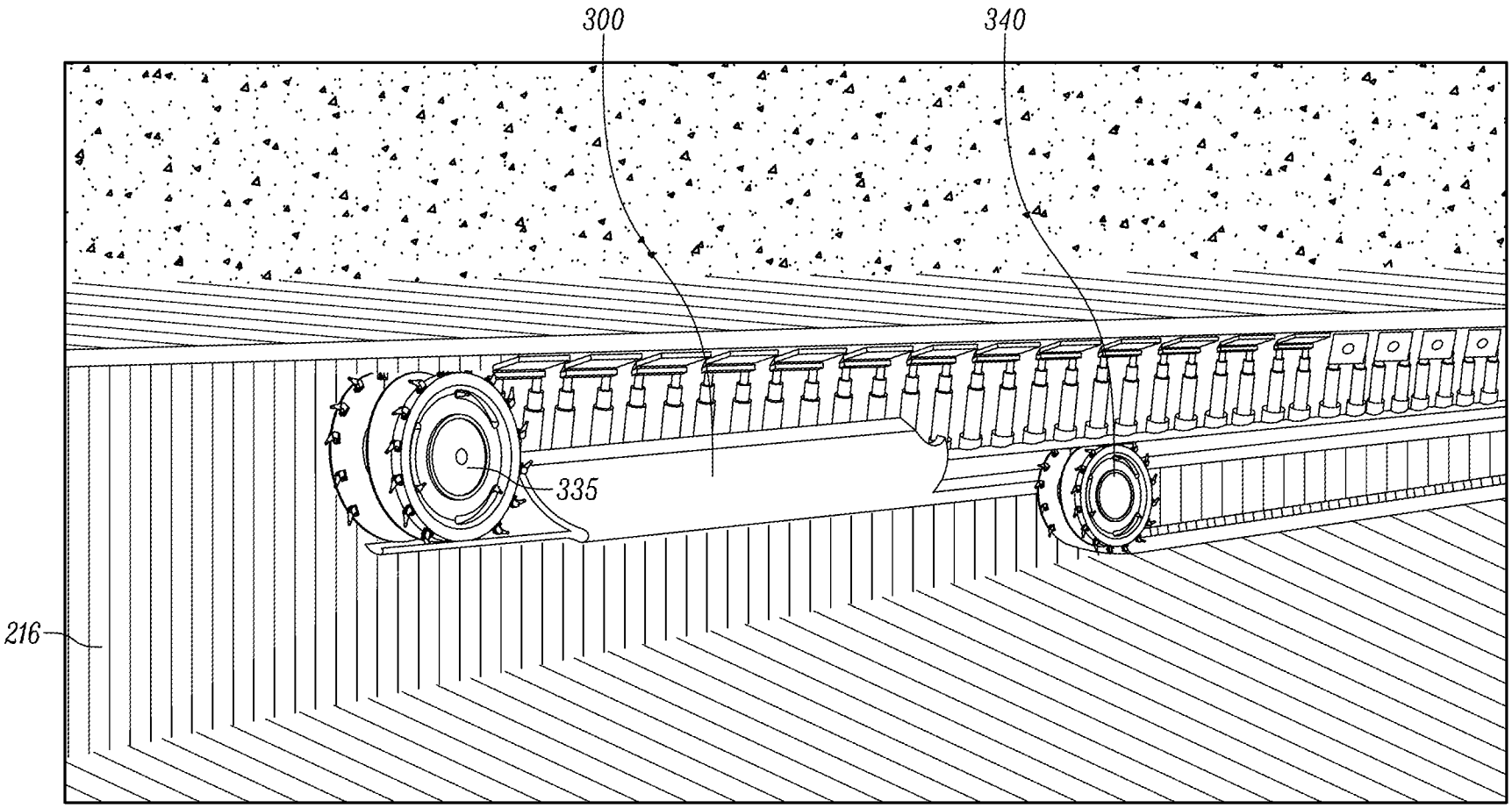

The shearer 300 is displaced laterally along the mineral face 216 in a bidirectional manner, though it is not necessary that the shearer 300 cut mineral bi-directionally. For example, in some mining operations, the shearer 300 is capable of being pulled bi-directionally along the mineral face 216, but only shears mineral when traveling in one direction. For example, the shearer 300 may be operated to cut mineral over the course of a first, forward pass over the width of the mineral face 216, but not cut mineral on its returning pass. Alternatively, the shearer 300 can be configured to cut mineral during both the forward and return passes, thereby performing a bi-directional cutting operation. Generally, a shearer cycle refers to the motion of the shearer 300 from a starting point (e.g., the maingate) to an end point (e.g., the tailgate) and back to the starting point. FIGS. 7A-7B illustrate the longwall shearer 300 as it passes over the mineral face 216 from a face-end view. As shown in FIGS. 7A-7B, the left cutter 340 and the right cutter 335 are staggered to increase the area of the mineral face 216 being cut in each pass of the shearer. In particular, as the shearer 300 is displaced horizontally along the AFC 215, the left cutter 340 is shown shearing mineral away from the lower half (e.g., a lower portion) of the mineral face 216 and may be referred to as a floor cutter herein, while the right cutter 335 is shown shearing mineral away from the upper half (e.g., upper portion) of the mineral face 216. The right cutter may be referred to as a roof cutter herein. It should be understood that in some embodiments, the left cutter 340 cuts the upper portion of the mineral face 216 while the right cutter 335 cuts the lower portion of the mineral face 216.

Figure 8:
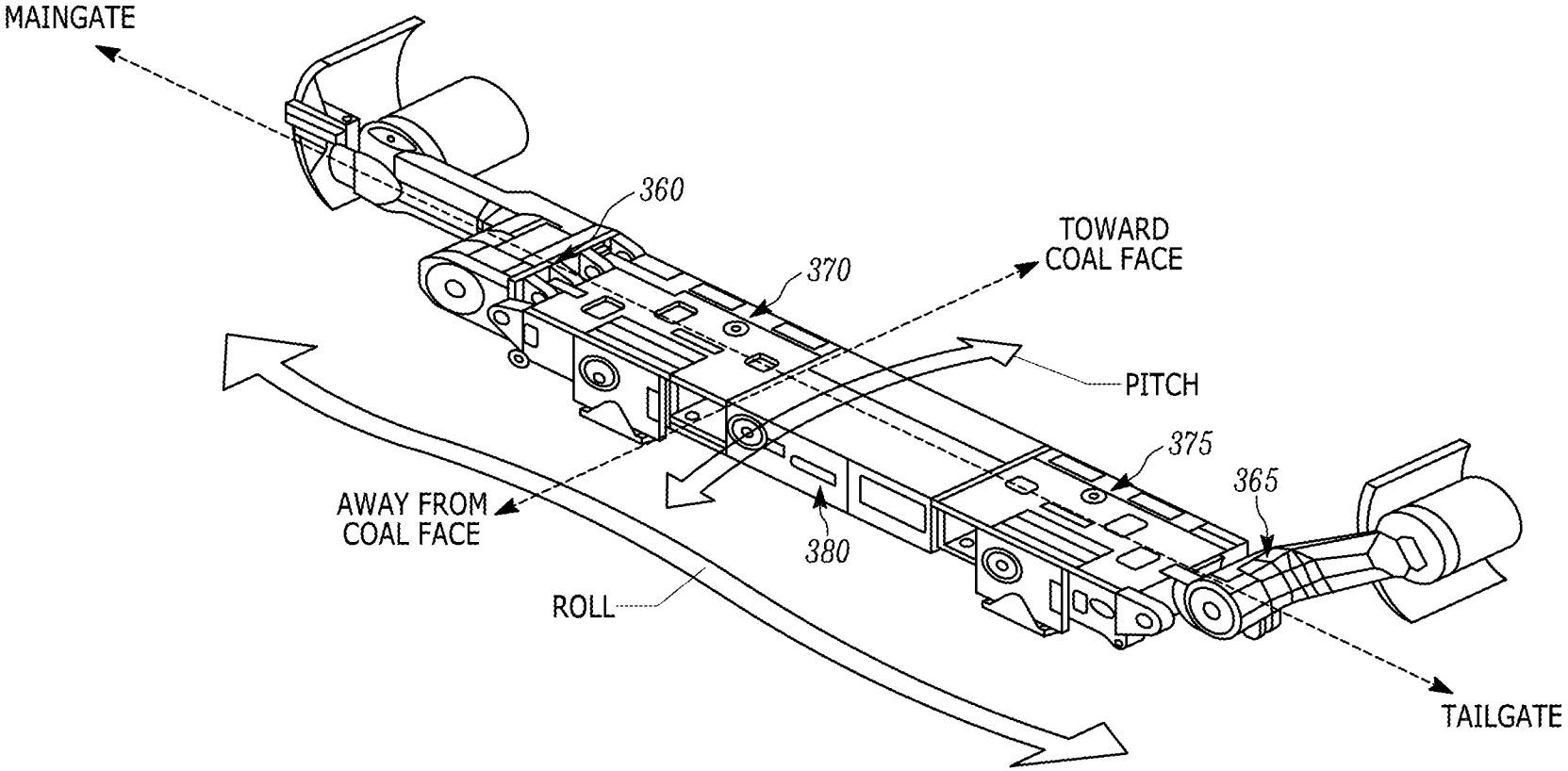
FIG. 8 illustrates approximate locations for sensors positioned in the shearer of the longwall mining system.

The shearer 300 also includes a controller 384 (FIG. 9) and various shearer sensors, to enable automatic control of the shearer 300. For example, the shearer 300 includes a left ranging arm angle sensor 360, a right ranging arm angle sensor 365, left haulage gear sensors 370, right haulage gear sensors 375, and a pitch and roll sensor 380. FIG. 8 shows the approximate locations of these sensors, although in some embodiments the sensors are positioned elsewhere in the shearer 300. The angle sensors 360, 365 provide information regarding an angle of slope of the cutter arms 315, 320. Thus, a relative position of the right cutter 335 and the left cutter 340 can be estimated using the information from the angle sensors 360, 365 in combination with, for example, known dimensions of the shearer 300 (e.g., length of cutter arm 315). The haulage gear sensors 370, 375 provide information regarding the position of the shearer 300 as well as speed and direction of movement of the shearer 300. The pitch and roll sensor 380 provides information regarding the angular alignment of the shearer 300.

As shown in FIG. 8, the pitch of the shearer 300 refers to an angular tilting toward and away from the mineral face 216. In the illustrated embodiment, the pitch angle of the shearer 300 is defined as the tilt of the shearer 300 from the face side to the goaf side. Positive pitch refers to the shearer 300 tilting away from the mineral face 216 (i.e., when the face side of the shearer 300 is higher than the goaf side of the shearer 300), while negative pitch refers to the shearer 300 tilting toward the mineral face 216 (i.e., when the face side of the shearer 300 is lower than the goaf side of the shearer 300). The pitch position of the shearer 300 is affected by the position of the AFC 215. Since the AFC 215 advances forward after each shearer pass, the pitch angle of the shearer 300 is determined, at least in part, by the ground line generated with the extraction of mineral (i.e., by the roof cutter 335 and the floor cutter 340) and on which the AFC 215 rests. In other words, when the shearer 300 is propelled forward across the mineral face 216 and extracts the mineral, the floor cutter 340 performing that extraction is removing mineral from the ground on which the AFC 215 will be positioned on the next pass. If the position of the floor cutter 340 does not change from one shearer pass to the next (i.e., as the shearer 300 advances forward through the mineral seam 217), the pitch angle of the shearer 300 should remain approximately the same from one shearer pass to the next because the floor cutter 340 continues to cut across the same, or approximately the same, ground level. However, if the position of the floor cutter 340 changes, either by raising or lowering the floor cutter 340, the pitch angle of the shearer 300 will soon also change when the AFC 215 advances over this ground just cut by the floor cutter 340. Additionally, seam irregularities and other factors may cause the angle of the ground beneath the AFC 215 to have an unexpected or undesirable angle toward or away from the mineral face 216, which would translate to the shearer 300 (supported by the AFC 215), affecting the shearer pitch angle.

For example, if the floor cutter 340 is lowered (i.e., cuts below the bottom of the AFC 215), the floor cutter 340 extracts mineral or material from a portion of the mineral face 216 that is below the current level of the AFC 215. Therefore, when the AFC 215 advances forward, at least the face side portion of the AFC 215 will be positioned on lower ground, which changes the pitch angle of the shearer 300 (e.g., decreases the pitch angle of the shearer 300). Analogously, if the floor cutter 340 is raised (i.e., cuts above the bottom of the AFC 215), the floor cutter 340 leaves (i.e., does not extract) a portion of the mineral face 216 that is above the current level of the AFC 215. Therefore, when the AFC 215 advances forward, at least the face side portion of the AFC 215 will be positioned on higher ground, which changes the pitch angle of the shearer 300 (e.g., increases the pitch angle of the shearer 300). Additionally, floor conditions (that is, a ground type) encountered by the shearer 300 also determine how much the pitch of the shearer 300 changes for the same change in height of the floor cutter 340. For example, the change in pitch of the shearer 300 may be different when the floor cutter 340 is lowered by two feet in hard rock floor than when the floor cutter 340 is lowered by the same two feet in soft clay floor.

Therefore, the current pitch angle of the shearer 300 depends on the ground type and the ground level that supports the AFC 215, and the future pitch angle of the shearer 300 depends on the ground type and the vertical position of the floor cutter 340 because the floor cutter 340 carves out, from the mineral face 216, the floor on which the AFC 215 will be advancing over. For example, lowering the floor cutter 340 will decrease the pitch angle of the shearer 300 as the AFC 215 advances, while raising the floor cutter 340 will increase the pitch angle of the shearer 300 as the AFC 215 advances. When the pitch of the shearer is too low, the shearer 300 risks crashing into the mineral face 216 and shutting down. However, when the pitch of the shearer 300 is too high, the shearer 300 may instead tip backward. Therefore, when the pitch of the shearer 300 operates outside of a desired pitch range, the shearer 300 increases the risk of causing downtime, and even damage to the shearer 300 or other parts of the mining system 200 (e.g., the roof support 205). Monitoring the position of the shearer 300 also minimizes down time of the longwall mining system 200 and minimizes the possibility of causing extraction problems such as, for example, degradation of mineral material, deterioration of mineral face alignment, formation of cavities by compromising overlying seam strata, and, in some instances, lack of monitoring may cause damage to the longwall mining system 200.

The roll of the shearer 300 refers to an angular difference between the right side of the shearer 300 and the left side of the shearer 300, as shown in FIG. 8. Positive roll refers to the shearer 300 tilting away from the right side (i.e., the right side of the shearer 300 is higher than the left side of the shearer 300), while negative roll refers to the shearer 300 tilting toward the right side (i.e., the left side of the shearer 300 is higher than the right side of the shearer 300). Both the pitch and the roll of the shearer 300 are measured in degrees. A pitch or a roll of zero indicates that the shearer 300 is leveled.

Figure 9:
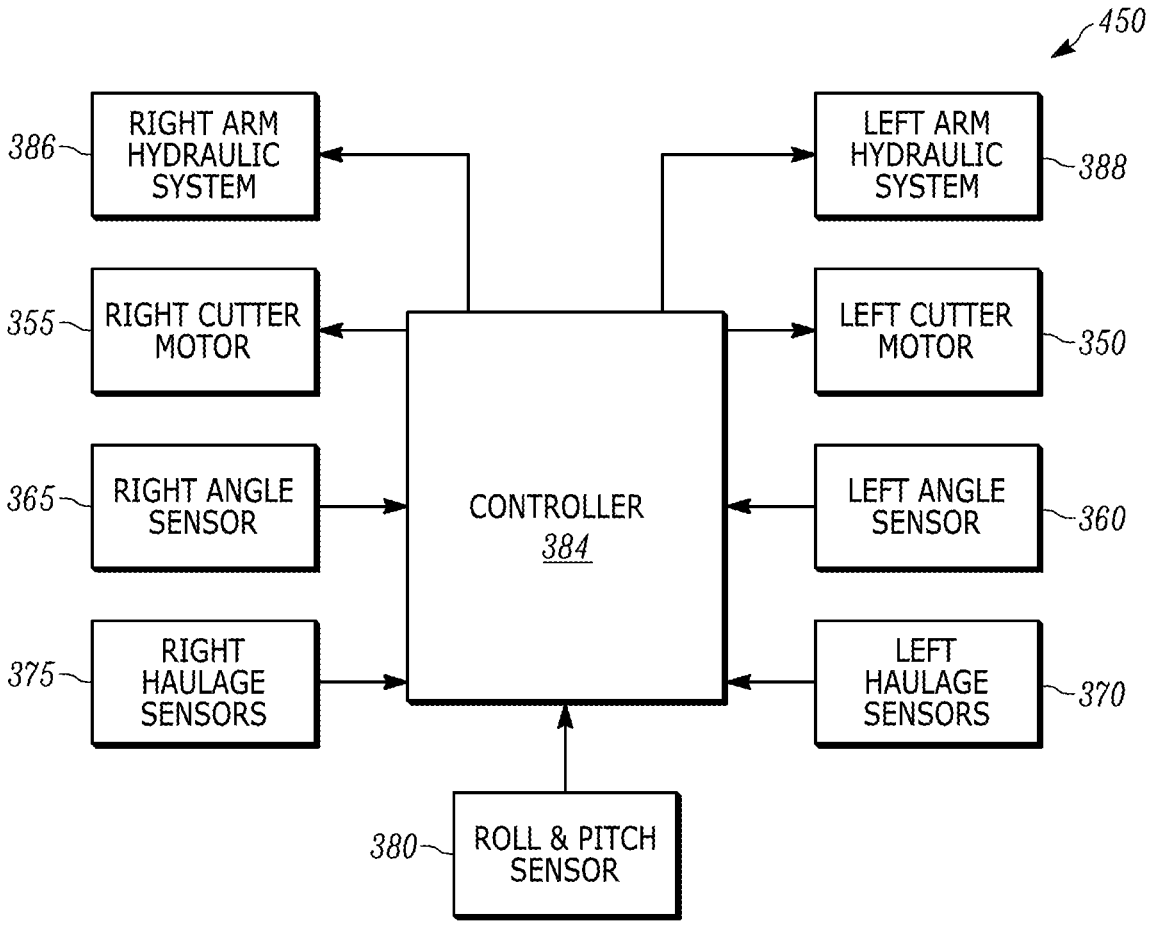
FIG. 9 is a schematic diagram of a controller of the shearer of FIGS. 6A-B.

The sensors 360, 365, 370, 375, 380 provide information to the controller 384 such that the operation of the shearer 300 may remain efficient. As shown in FIG. 9, the controller 384 is also in communication with other systems related to the shearer 300. For example, the controller 384 communicates with the right arm hydraulic system 386 and with the left arm hydraulic system 388. The controller 384 monitors and controls the operation of the hydraulic systems 386, 388 and the motors 350, 355 based on signals received from the various sensors 360, 365, 370, 375, 380. For example, the controller 384 may alter the operation of the hydraulic systems 386, 388 and the motors 350, 355 based on the information received from the sensors 360, 365, 370, 375, 380.

Figure 10:
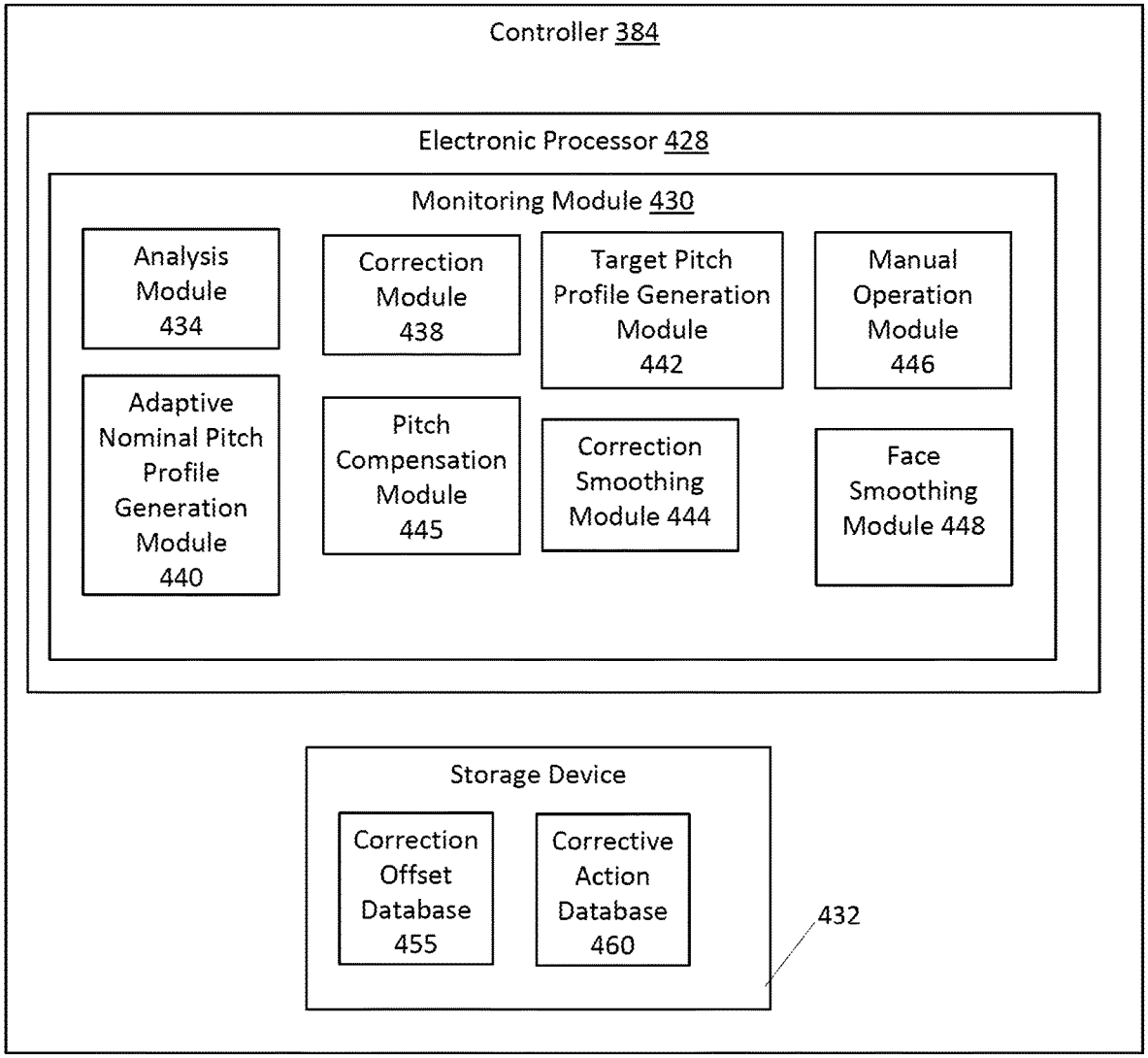
FIG. 10 is a schematic diagram of a monitoring module of the longwall mining system.

In particular, the controller 384 operates the shearer 300 in a pitch steering mode in which the controller 384 monitors pitch data related to the shearer 300 and controls the position of the floor cutter 340 based on the pitch position of the shearer 300. As shown in FIG. 10, the controller 384 includes an electronic processor 428 (for example, a microprocessor, application-specific integrated circuit (ASIC), or another suitable electronic device), and a storage device 432 (for example, a non-transitory, computer-readable storage medium). The controller 384 may include other components such as inputs, outputs, communication buses and the like that allow the controller 384 to operate as described below. The electronic processor 400 includes a monitoring module 430 that monitors the shearer position data obtained through the sensors 360, 365, 370, 375, 380. The monitoring module 430 includes an analysis module 434 that receives the position data, which includes information regarding the position of the shearer 300, and compares the position of the shearer 300 with a desired shearer position. The monitoring module 430 also includes a correction module 438 that controls the operation of the shearer 300 and implements a corrective action such that the pitch position of the shearer approaches the desired shearer pitch position.

In the illustrated embodiment, the controller 384 also includes an adaptive nominal pitch profile generation module 440, a target pitch profile generation module 442, a correction smoothing module 444, a pitch compensation module 445, a manual operation module 446, and a face-wide smoothing module 448. The adaptive pitch profile generation module 440 generates a nominal pitch profile for the analysis module 434 based on historical information regarding previous nominal pitch profiles and requested corrections on the nominal pitch profiles. The target pitch profile generation module 442 assigns values to a target pitch profile based on the nominal pitch profile and on received correction offsets. The correction smoothing module 444 receives the correction offsets and generates the gradual ramps to be implemented by the shearer 300 to inhibit large changes in pitch angle as the shearer 300 travels along the AFC 215. The pitch compensation module 445 analyzes whether the correction module 438 achieves the desired correction in pitch of the shearer 300 and determines whether a pitch compensation value should be considered when determining the corrective action. The manual operation module 446 detects when an operator wishes to operate the shearer 300 manually and suspends control based on the target pitch profile. The face-wide smoothing module 448 analyzes the changes in pitch in one pass of the shearer 300 and inhibits large changes in the pitch angle to occur within a pass of the shearer 300.

The monitoring module 430, including the various modules 434-448, is implemented by the electronic processor 428. In one example, the modules may be associated with instructions stored on the storage device 432 that are retrieved and executed by the electronic processor 428 to carry out the functions attributable to the various modules. In some embodiments, the modules are implemented by other combinations of software and hardware components including, for example, ASICS or FPGAs. Regardless of the particular implementation, the various functions of the modules described herein, including the various steps of the flowcharts described below, may also be described as being performed by the electronic processor 430 (for example, by execution of instructions retrieved from a memory, such as the storage device 432).

In some embodiments, the controller 384 also monitors and controls other operations and parameters of the shearer 300. For example, as discussed in more detail below, while the controller 384 operates the shearer 300 in the pitch steering mode, the controller 384 may also control the roof cutter 335 in a selected mode. In some embodiments, an initial cutting sequence (e.g., a pass along the mineral face 216) and extraction heights (e.g., heights of the cutters 335, 340) are defined by use of an offline software utility, which is then loaded on to the shearer control system as a cutting profile. Once the shearer controller 384 has access to the initial cutting sequence and the extraction heights, the controller 384 controls the shearer 300 such that the shearer 300 automatically replicates the pre-defined cutting profile until conditions in the mineral seam 217 change. When seam conditions change, an operator of the shearer 300 may override control of the cutters 335, 340 while the controller 384 records the new roof/floor horizon as a new cutting profile.

Additionally, the cutting profile may define different cutter heights for different sections along the mineral face 216. For reference purposes, the mineral face 216 may be divided up into sections based on roof supports. For a simple example, the longwall system may include one hundred roof supports along the mineral face 216, and the cutting profile for a single shearer pass may specify cutter heights every ten roof supports. In this example, ten different cutter heights, one for each section of ten roof supports, would be included in a cutting profile for a single shearer pass to define the cutter heights for the entire wall. The size of the sections (i.e., the number of roof supports per section) may vary depending on the desired precision and other factors.

Figure 11:
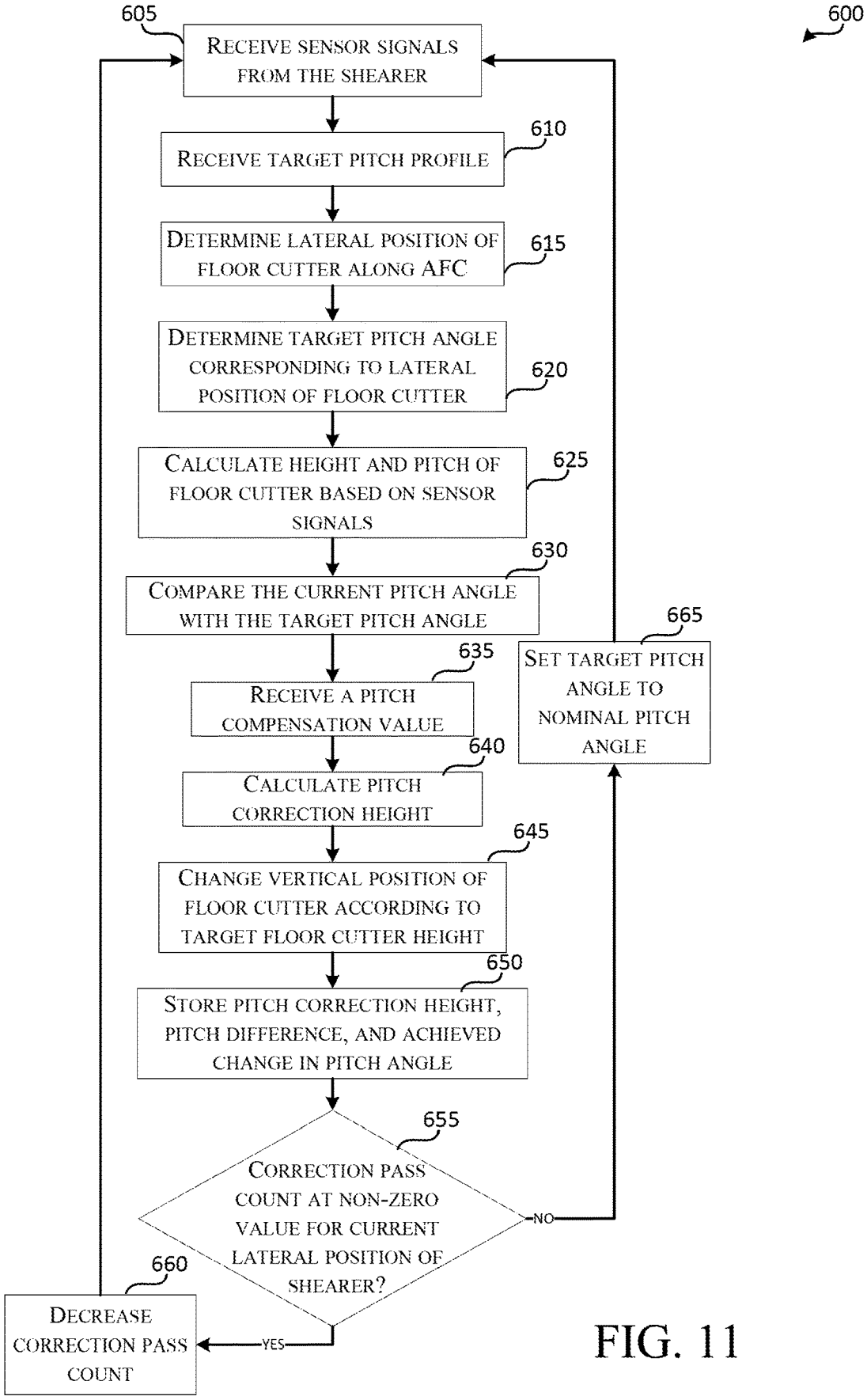
FIG. 11 is a flowchart illustrating a method of monitoring a pitch angle of the shearer.

FIG. 11 illustrates a method 600 implemented by the analysis module 434 and the correction module 438 to maintain the shearer 300 operating within desired pitch position parameters. As shown in FIG. 11, the analysis module 434 receives sensor signals from the sensors 360, 365, 370, 375, 380 (block 605). The analysis module 434 also receives the target pitch profile (block 610). The target pitch profile is an array that defines the target pitch angles for the length of the mineral face 216. In one example, the target pitch profile may include an array having a length equal to the number of pans of the longwall system 200. In another example, the target pitch profile may include an array having a length that is less than the number of pans such that a sub-group of pans is associated with a single target pitch angle. For example, each group of five, ten, or twenty pans along the mineral face 216 may be associated with a respective target pitch angle. Each target pitch angle identifies a desired pitch angle for the corresponding location of the shearer 300. The target pitch profile is intended to reflect the actual pitch angle of the mineral seam.

Figure 12:
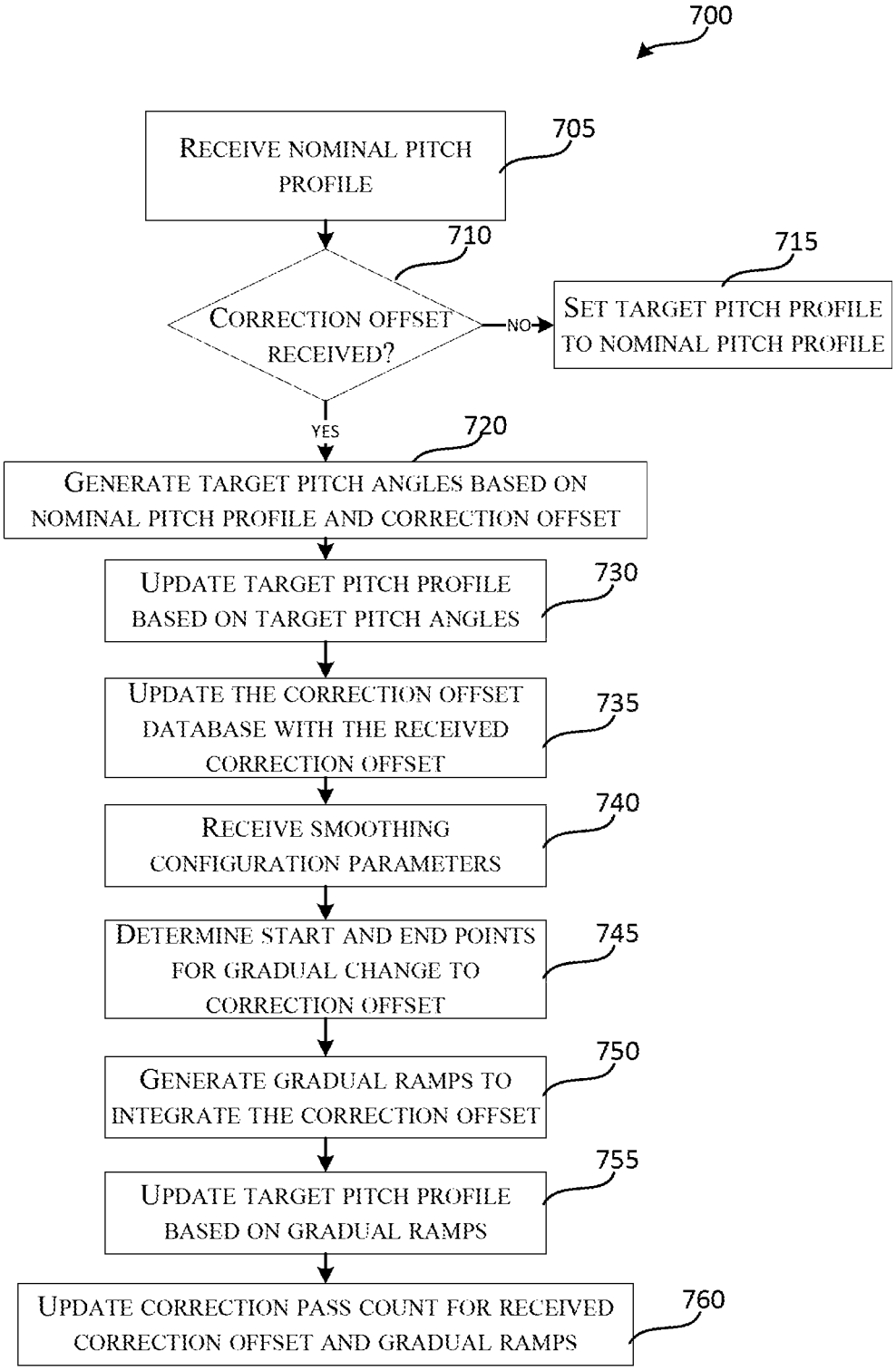
FIG. 12 is a flowchart illustrating a method of generating a target pitch profile.

FIG. 12 provides more details regarding the generation of the target pitch profile. In some embodiments, the target pitch profile may be generated by the electronic processor 428. In other embodiments, however, a separate controller and/or an external controller may generate the target pitch profile and may transmit the target pitch profile to the analysis module 434. In some instances, the target pitch profile includes a target pitch angle and a target pitch angle tolerance. In some embodiments, the target pitch profile only indicates the target pitch angle and the analysis module 434 accesses the target pitch angle tolerance from a memory (e.g., of the controller 384 or the remote monitoring system 400) previously stored at a configuration stage or at the time of manufacture. As discussed above, in some embodiments, rather than defining a target pitch angle for each pan of the AFC 215, the target pitch profile defines a target pitch angle for groups of pans. For example, the longwall system may include one hundred roof supports along the mineral face 216, and the target pitch profile for a single shearer pass may specify a target pitch angle for every ten roof supports. In this example, ten different target pitch angles, one for each section of ten roof supports, would be included in a target pitch profile for a single shearer pass to define the pitch angles for the entire wall. The size of the sections (i.e., the number of roof supports per section) may vary depending on the desired precision and other factors.

The analysis module 434 then determines the lateral position of the shearer 300 along the AFC 215 (block 615). In other words, the analysis module 434 determines which pan corresponds to the current lateral position of the shearer 300. Specifically, the analysis module 434 determines the lateral position of the floor cutter 340 along the AFC 215. The analysis module 434 also determines the target pitch angle for the shearer 300 corresponding to the current lateral position of the floor cutter 340 (block 620). For example, when the analysis module 434 determines that the floor cutter 340 is positioned at the tenth pan of the AFC 215, the analysis module 434 then retrieves the target pitch angle, from the target pitch profile, that corresponds to the tenth pan of the AFC 215. The analysis module 434 also determines the height and the pitch of the floor cutter based on the received sensor signals (block 625). The analysis module 434 then compares the current pitch angle (that is, the pitch angle of the floor cutter 340) with the target pitch profile (block 630).

When the analysis module 434 compares the current pitch angle of the shearer 300 to the target pitch profile, the analysis module 434 determines a pitch difference indicative of the difference between the current pitch angle and a target pitch angle (that is, the pitch angle specified by the target pitch profile at the current location of the floor cutter 340 along the mineral face 216, respectively). For example, the target pitch profile may indicate a target pitch angle. In such embodiments, the pitch difference corresponds to the difference between the target pitch angle and the current pitch angle of the shearer 300. In other embodiments, however, the target pitch profile may indicate a high pitch threshold, a low pitch threshold, or a combination thereof. In such embodiments, the pitch difference refers to the difference between the current pitch angle of the shearer 300 and the high pitch threshold or the low pitch threshold. The analysis module 434 also receives a pitch compensation value (block 635). The pitch compensation value provides a measure of how much the pitch angle typically changes in response to changes in the position of the floor cutter 340. As described in further detail below with respect to, for example, FIG. 17, the pitch compensation value helps the analysis module 434 determine a more accurate correction value to achieve the target pitch angle for the shearer 300.

The correction module 438 proceeds to determine a pitch correction height based on the pitch difference and the pitch compensation value (block 640). In other words, the correction module 438 determines the target vertical position of the floor cutter 340 such that the change in vertical position of the floor cutter 340 achieves the desired change in pitch angle. The correction module 438 calculates the pitch correction height by translating the pitch difference to a change in vertical position of the floor cutter 340 (e.g., −0.5 m) and adding the pitch compensation value (e.g., 0.1 m) to determine the target vertical position of the floor cutter 340 (e.g., −0.3 m, down from the current vertical position of 0.1 m). The correction module 438 communicates with the left arm hydraulic system 388 and/or the right arm hydraulic system 386 to change the vertical position of the floor cutter 340 such that the respective arm hydraulic system 386, 388 lowers (or rises) the floor cutter 340 to the pitch correction height (e.g., the target vertical position of the floor cutter 340) at block 645. Once the floor cutter 340 is lowered and the AFC 215 is advanced forward, the pitch angle of the shearer 300 changes and approaches the target pitch angle. The analysis module 434 stores, in the corrective action database 460, the pitch correction height, the pitch difference, and the resulting pitch change after the correction module 438 changes the vertical position of the floor cutter 340 (also referred to as the achieved change in pitch angle) at block 650.

The correction module 438 then determines whether the correction pass count for the current lateral position of the floor cutter 340 is at a non-zero value (block 655). As explained in more detail with respect to FIG. 12, a non-zero correction pass count indicates that the target pitch profile includes a target pitch angle input based on a correction offset. The value of the correction pass count indicates the number of passes of the shearer 300 for which the target pitch angle is based on the correction offset. Accordingly, after the correction module 438 moves the floor cutter 340 to the pitch correction height, the correction module 438 also decreases the correction pass count (block 660) to indicate that the correction has already been applied to one shearer pass. The analysis module 434 then continues to monitor the pitch angle based on the target pitch profile until additional correction offsets are received. The analysis module 434 then continues to monitor the pitch angle of the shearer 300 at block 605. Otherwise, when the correction pass count is at zero, the analysis module 434 sets the target pitch angle to a nominal pitch angle (block 665). The nominal pitch angle, which is discussed in further detail below, includes an uncorrected estimate of the desired pitch angle for the shearer 300 at the current position of the shearer 300 along the AFC 215. After setting the target pitch angle to the nominal pitch angle, the analysis module 434 continues to monitor the pitch angle of the shearer 300 (block 605).

In general, the larger the pitch difference, the larger the necessary change in vertical position of the floor cutter 340 to correct the pitch angle of the shearer 300. In some embodiments, the analysis module 434 and the correction module 438, calculate the correction pass count to the pitch angle changes to avoid sudden changes over short each shearer pass. For example, the correction module 438 may implement a maximum pitch change threshold to avoid sudden pitch angle changes. In one example, the analysis module 434 may determine that the pitch difference corresponds to 10°. The correction module 438, however, may determine that, instead of changing the pitch angle by 10° in one pass, the pitch angle will be changed over three passes, each increasing the pitch angle by 4°, 4°, and 2°, respectively, to bring the pitch angle of the shearer 300 to the target pitch angle.

In addition, the physical characteristics of the shearer 300 (e.g., the length of the cutter arms 315, 320) and the AFC (e.g., the depth of the AFC 215) may also restrict the size of the pitch angle change achieved in each pass of the shearer 300. For example, the cutters 335, 340 may be restricted to a maximum vertical height of, for example, 3 m, and a minimum vertical height of, for example, −1.0 m. Therefore, the target vertical position of the floor cutter 340 does not exceed the maximum vertical height or the minimum vertical height. In other words, even if the correction module 438 calculates the desired vertical position of the floor cutter 340 to be either above the maximum vertical height or below the minimum vertical height, the correction module 438 will determine that the desired vertical position in those situations is equal to the maximum vertical height or the minimum vertical height, as appropriate. In such instances, however, even after the floor cutter 340 is moved to the desired vertical position, the change in vertical position may not be sufficient to bring the shearer 300 into the target pitch angle. Therefore, in such instances, the pitch angle for the shearer 300 may require more than one pass to correct the pitch angle.

The pitch angle detection and corrective action relies in part on the floor cutter 340 trailing the main body of the shearer 300. In other words, it relies in part on the floor cutter 340 being positioned on the end of the shearer 300 opposite the direction of travel during shearing. Accordingly, since the shearer 300 and the floor cutter 340 are mechanically connected (e.g., mechanically bound) in the same plane, the pitch of the shearer 300 equals the pitch of the floor cutter 340. The controller 384 can then determine whether the current pitch angle of the floor cutter 340 is within a target pitch angle range, and adjust the vertical position of the trailing floor cutter 340, as appropriate. In such embodiments, the controller 384 continuously monitors the current pitch angle of the shearer 300 and takes corresponding corrective action (lowering/raising the floor cutter 340) during a single shearer pass. Before the next shearer pass, the AFC 215 advances forward over the surface that was just sheared with the pitch angle correction techniques. Then, on the next shearer pass, the pitch angle correction is at least partially realized by the shearer 300, because the AFC 215 is located on the just-sheared surface.

FIG. 12 illustrates a method 700 of generating the target profile used to monitor the pitch of the shearer 300 as discussed above with respect to FIG. 11. As shown in FIG. 12, the target pitch profile generation module 442 first receives a nominal pitch angle profile (block 705). The target pitch profile generation module 442 receives the nominal pitch profile, for example, in response to a selection from an operator. That is, an operator of the longwall system 200 may select a nominal pitch profile from a nominal pitch profile database. The nominal pitch profile database stores a plurality of different nominal pitch profiles. Each nominal pitch profile includes an array that defines the nominal pitch angles for the length of the mineral face 216. In some embodiments, the nominal pitch profile may include an array having a length equal to the number of pans in the longwall system 200 and may specify a nominal pitch angle for each pan. In some embodiments, the nominal pitch profile may include an array with a length that is less than the number of pans such that a sub-group of pans is associated with a nominal pitch angle. For example, each group of five, ten, or twenty pans along the mineral face 216 may be associated with a respective nominal pitch angle. Each nominal pitch angle identifies an expected pitch angle for the corresponding location of the shearer 300. The nominal pitch profile includes electronic data received from, for example, an operator or user manually inputting data (e.g., via a keyboard, mouse, touch screen, or other user interface), mineral seam modeling software providing the nominal pitch profile, data output by a real-time mineral seam monitoring system, a remote supervisor/operator outside of the mine site (e.g., via the remote monitoring system 400), a combination thereof, or another source. The nominal pitch profile indicates the pitch angles that are expected to make the shearer 300 follow the natural mineral seam. The nominal pitch profile typically is generated based on the geological observations and/or measurements at the mine location and indicates the expected desired pitch angle for the shearer 300 based on the lateral position of the shearer 300 along the AFC 215.

The target pitch profile generation module 442 then determines whether any correction offsets are received (block 710). When the target pitch profile generation module 442 does not receive any correction offsets, the target pitch profile is set to the nominal pitch profile (block 715). That is, the target pitch angle values are set to the nominal pitch angle values. The analysis module 434 can then access the target pitch profile and control the shearer 300 according to the target pitch profile as described in FIG. 11, in particular blocks 610, 620, 630, and 640. On the other hand, when the target pitch profile generation module 442 does receive correction offsets, the target pitch profile generation module 442 generates the target pitch angles based on the nominal pitch profile and the correction offsets (block 720).

The correction offsets are based on observations by the operator and/or other user associated with the longwall system 200 indicating that the current vertical height of the roof cutter 335 and/or the floor cutter 340 does not match the vertical height of the mineral seam 217. The operator then inputs correction offsets to the longwall system 200 to raise or lower the cutters 335, 340 to bring the system back into alignment with the mineral seam 217. Accordingly, the correction offsets include a change in pitch angle to the nominal pitch profile based on an observation or other knowledge of the real mineral seam. The correction offsets also include an indication of pan locations (that is, the pan location along the mineral face 216) at which to apply the pitch angle correction, and a correction pass count. As mentioned above, the correction pass count indicates the number of passes for which the correction offset is to be applied to the target pitch profile. For example, an operator may determine (e.g., from visual inspection) that the pitch angle is to be increased and maintained over multiple passes to achieve an appropriate altitude change by the shearer 300, and thereby maintain an efficient extraction by the shearer 300. The operator then requests that the pitch angle be altered for the particular location of the shearer 300 along the mineral face 216, and inputs the alteration of the pitch angle and the correction pass count to apply the pitch angle correction as a correction offset to the nominal pitch profile. These correction offsets, therefore, allow the shearer 300 to vertically align with the mineral seam 217 via an altitude change due to the correction offsets being applied over the number of passes specified by the correction pass count.

The analysis module 434 may receive the correction offsets via, for example, a user input such as a keyboard, mouse, touch screen, or other user interface). The user inputs may be part of, for example, a human-machine interface located along the working mineral face 216. In other embodiments, the user inputs may be part of a remotely located human-machine interface that allows a remote supervisor/operator outside of the mine site to input pitch correction offsets. Alternatively, the user input may be part of a portable wireless device associated with a particular operator of the longwall system 200, and/or may be part of an external control system that may automatically generate correction offsets. As mentioned above, when the target pitch profile generation module 442 determines that a correction offset is received, the target pitch profile generation module 442 generates the target pitch angles for the specified pan locations based on both the nominal pitch profile and the correction offset (block 720). Notably, the target pitch profile generation module 442 may receive correction offsets as the shearer 300 continues to operate and shear mineral from the mineral face 216. The analysis module 434 may then receive an updated target pitch profile each time the target pitch profile is updated by the target pitch profile generation module 442, which allows the correction offsets to be implemented as soon as the shearer 300 reaches the location of the correction offset. For example, a correction offset is received for the fiftieth pan through the sixtieth pan while the shearer 300 is at, for example, the tenth pan. The target pitch profile generation module 442 updates the target profile in response to receiving the correction offset and, when the shearer 300 reaches the fiftieth pan on the same pass, the correction module 438 implements the correction offset.

Figure 13:
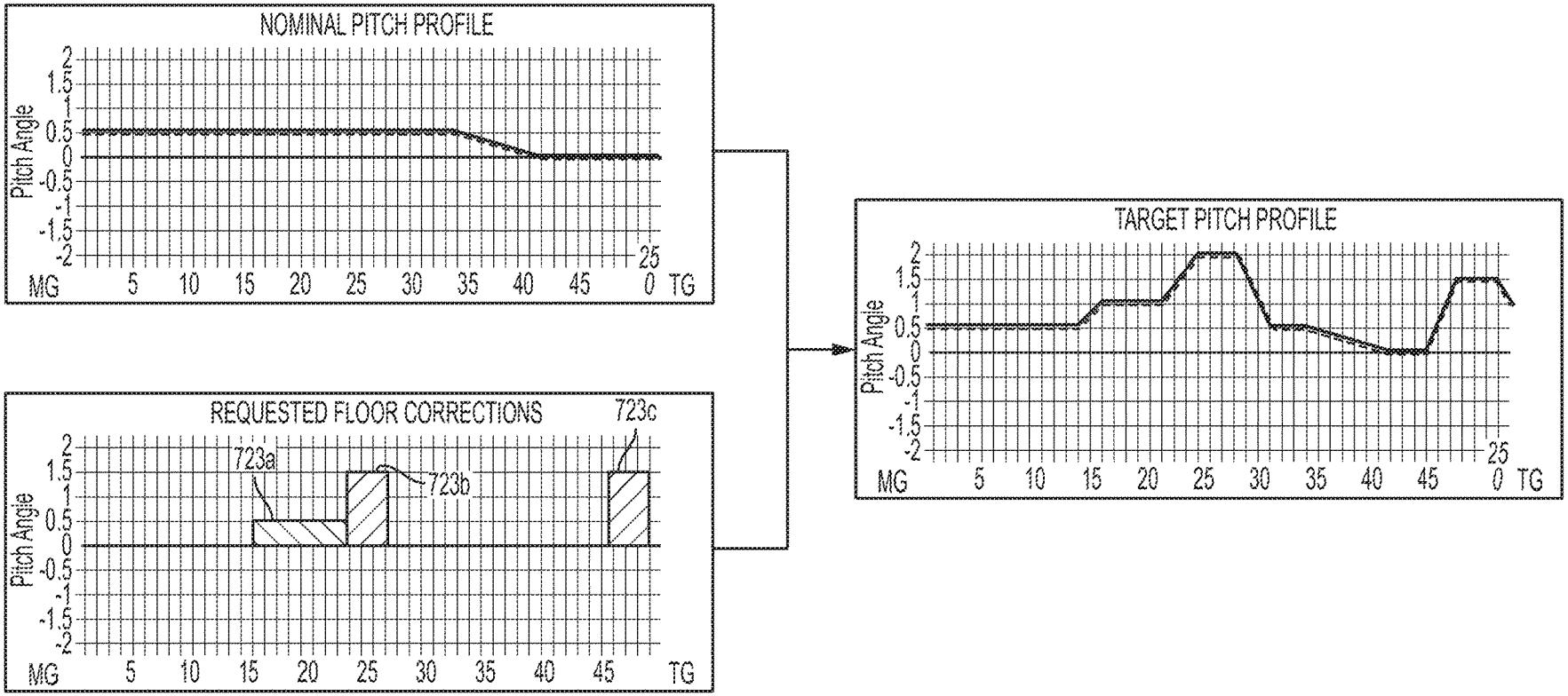
FIG. 13 is a diagram of combining a nominal pitch profile and a correction offset.

For example, FIG. 13 illustrates a nominal pitch profile and a received correction offset. The target pitch profile generation module 442 adds correction offset 723*a-c* to the nominal pitch angles corresponding to the same locations as the correction offsets to generate target pitch angles for the section of the mineral face 216 specified by the correction offset (that is, the section of the mineral face 216 specified by the start and end pan locations of the correction offset).

As shown in FIG. 13, a first correction offset 723*a* indicates an increase in the pitch angle by 0.5° between pans 15 and 23, a second correction offset 723*b* indicating an increase of 1.5° between pans 23 and 26, and a third correction offset 723*c* also indicating an increase of 1.5° between pans 45 and 48. The correction offsets are then summed to the nominal pitch profile and smoothed by the correction smoothing module 444 as described below, which generates a target profile as shown in FIG. 13. The target pitch profile generation module 442 then updates the target pitch profile to include the target pitch angles (block 730). For the locations of the shearer 300 along the mineral face 216 for which a correction offset is not received (and which are not updated by the correction smoothing module 444 described below), the target pitch profile remains unchanged. That is, the target pitch profile may be set to the nominal pitch angles for some of the regions of the mineral face 216 and may be set to the calculated target pitch angles for other regions of the mineral face 216 for which correction offsets are received. The target pitch profile generation module 442 (or the analysis module 434) then updates the correction offset database with the received correction offset (block 735).

Figure 14:
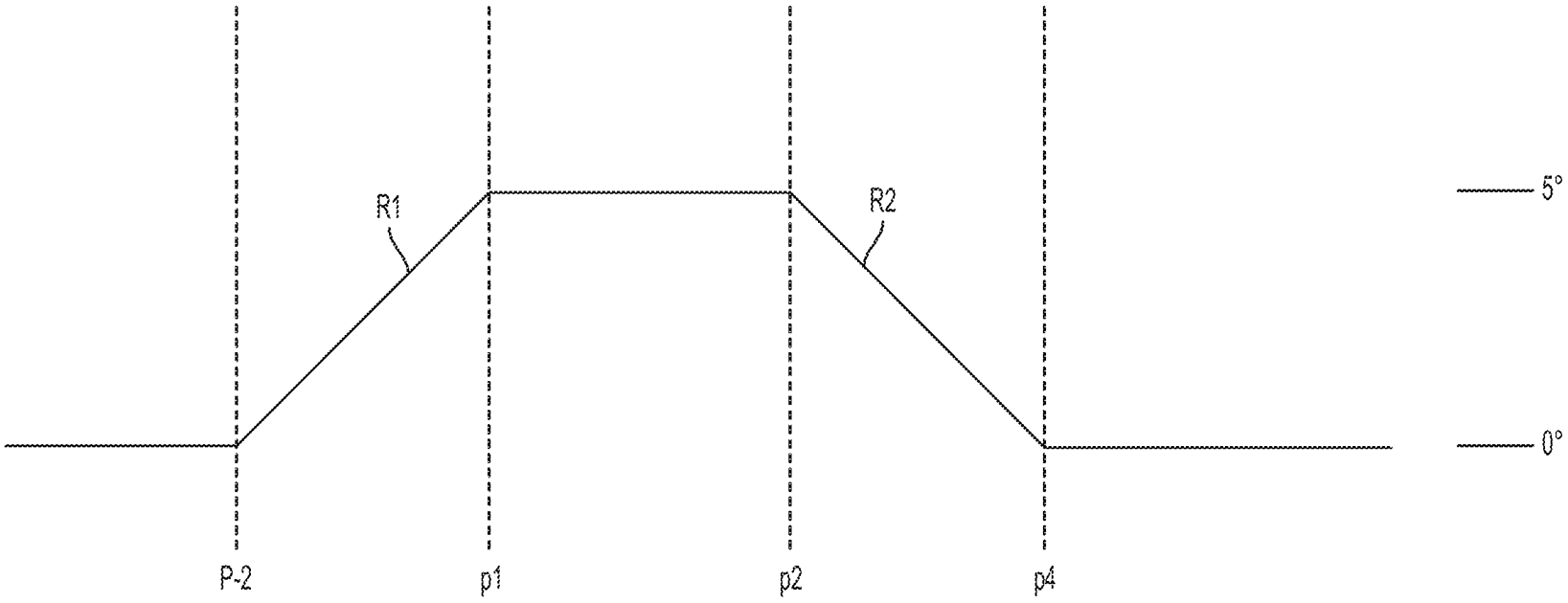
FIG. 14 is a diagram illustrating smoothing performed by a correction smoothing module.

The correction smoothing module 444 then accesses the target pitch profile generated by the target pitch profile generation module 442. The correction smoothing module 444 receives smoothing configuration parameters (block 740). The smoothing configuration parameters may include, for example, a maximum change in pitch per pan, a function to generate gradual ramps described in more detail below, and the like. The correction smoothing module 444 may receive a user input indicating the smoothing configuration parameters and/or may access the smoothing configuration parameters from a memory. Based at least in part on the smoothing configuration parameters, the correction smoothing module 444 determines start and end points for a gradual change to the correction offset (block 745). FIG. 14 illustrates an example of a correction offset being smoothed by the correction smoothing module 444. As shown in FIG. 14, the target pitch angle at the start of the correction offset (p1) may be set to zero degrees, the target pitch angle during the correction offset may be set to five degrees, and the target pitch angle at the end of the correction offset (p2) may again be set to zero degrees. The correction smoothing module 444 then determines, based on the smoothing configuration parameters, that the gradual ramps to reach the five degree correction offset will have a start point of two pans before (p−2) the start of the correction offset and, an end point of two pans after (p4) the end of the correction offset.

The correction smoothing module 444 then generates the gradual ramps to integrate the correction offset smoothly into the remainder of the target pitch profile (block 750). As shown in FIG. 14, the correction smoothing module 444 uses a linear function to generate the gradual ramps (R1, R2) that integrate the correction offset smoothly into the target pitch profile.

In other embodiments, however, the correction smoothing module 444 may use different functions to generate the gradual ramps. The correction smoothing module 444 then updates the target pitch profile based on the generated gradual ramps (block 755). The correction smoothing module 444 then also updates the correction pass count to the value specified by the correction offset for the received correction offset locations and the gradual ramp pan locations (block 760). With respect to the example of FIG. 14, the correction pass count is updated for pan locations ranging from p−2 to p4. The analysis module 434 may then access the target pitch profile and the correction pass count and control the shearer 300 according to the target pitch profile and the correction pass count as described previously with respect to FIG. 11.

Figure 15A:
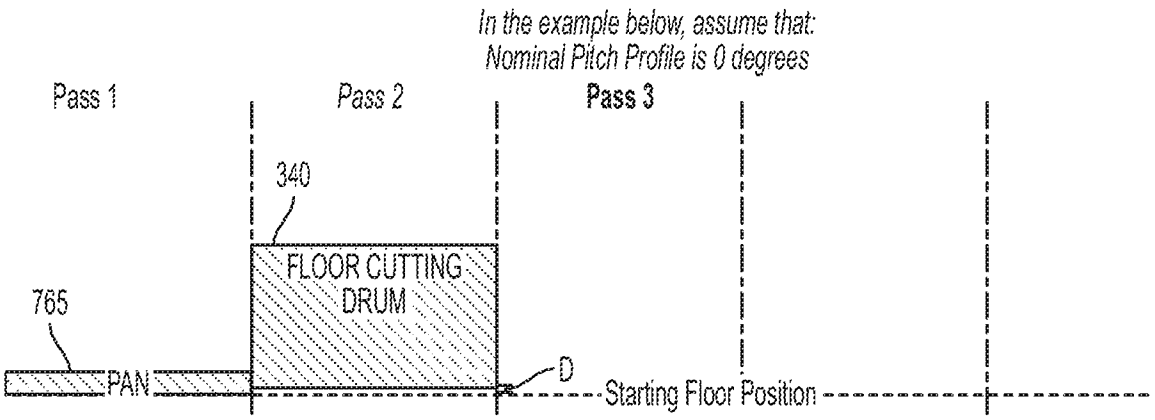
FIGS. 15A-C are diagrams of the longwall mining system as a correction offset is implemented.
Figure 15B:
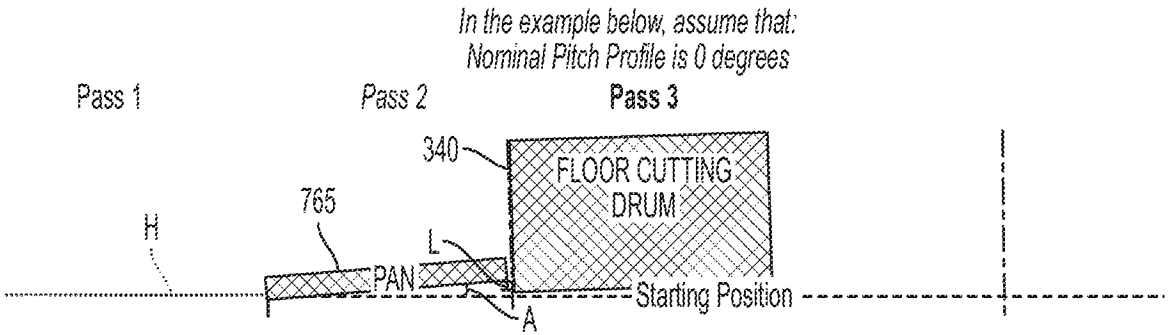
Figure 15C:
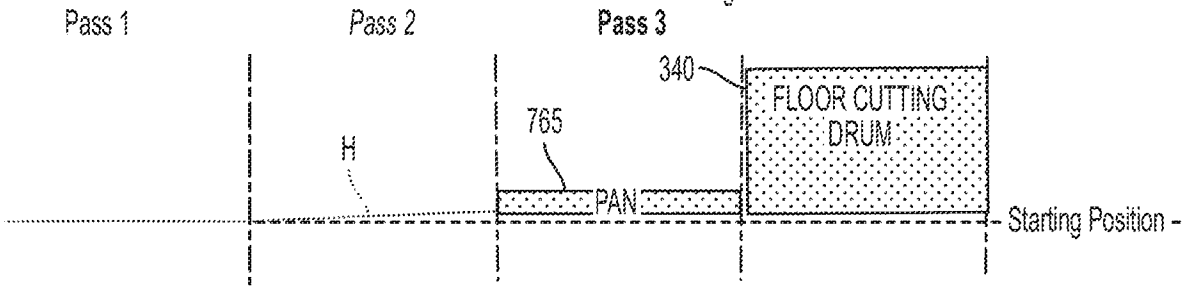

FIGS. 15A-C illustrate an example of the analysis module 434 controlling the shearer 300 according to the target pitch profile as described with respect to FIG. 11. The roof cutter 335 and the floor cutter 340 are positioned in front of the central housing 305 of the shearer 300 (i.e., closer to the mineral face 216), as shown in FIG. 4. The central housing 305 of the shearer 300 is supported on a track of the AFC 215, which is separated into sections, referred to as pans. Accordingly, FIGS. 15A-C illustrate a pan 765 that is representative of the location of the central housing 305 of the shearer 300. FIGS. 15A-C illustrate three passes of the shearer 300, a first pass (pass 1) in FIG. 15A, a second pass (pass 2) in FIG. 15B, and a third pass (pass 3) in FIG. 15C. Before the first pass, the target pitch profile has been set to a nominal pitch angle at the location of pan 765 along the mineral face 216, which, in this example, is equal to zero degrees. Accordingly, the pan 765 is shown to be at a pitch angle of zero degrees at the first pass in FIG. 15A. While the pan 765 is on the first pass, however, the target pitch profile is set to the nominal pitch angle plus a correction offset at the location of pan 765 along the mineral face 216. Since the target pitch profile on the first pass of the shearer 300 includes a correction offset, the correction pass count is set to a non-zero value. In this example, the correction pass count is set to one. In other words, the correction offset only applies to the first pass of the shearer 300. Accordingly, FIG. 15A illustrates the floor cutting drum 340 at a target height D. That is, FIG. 15A illustrates the correction module 438 changing the vertical position of the floor cutter 340 as described above with respect to block 645 of FIG. 11. After shearing on the first pass, the correction module 438 then determines that the correction pass count is at a value of one, and decreases it to a value of zero (that is, decrements the correction pass count by one) to indicate that the correction offset has been applied.

When the AFC 215 advances, the pan 765, and therefore the shearer 300 supported by the pan 765, changes pitch because the floor cutter had cut at target height D on the first pass of the shearer 300. As shown in FIG. 15B, when shearer 300 advances to the second pass, the pitch of the shearer 300 changes to a pitch angle A due to the change in height of the floor cutter 340 implemented by the correction module 438 on the first pass of the shearer 300. As the analysis module 434 and the correction module 438 monitor the position of the floor cutter 340 on the second pass, because the correction pass count is set to zero, the target pitch angle is set to the nominal pitch angle (in this example, zero degrees) as discussed with respect to step 665. The controller 384 then decreases the cutting height of the floor cutter 340 to achieve the target pitch angle of zero degrees. As shown in FIG. 15B, in the illustrated embodiment, the controller 384 decreases the height of the floor cutter 340 by distance L, with respect to the pan 765. Additionally, dotted line H represents the historical pan line of the shearer 300 at the pan location. As shown in FIG. 15B, during the first pass, the pitch of the shearer 300 was at zero degrees.

When the AFC 215 advances for the third pass, as shown in FIG. 15C, the decrease in cutting height (e.g., the decrease by distance L) of the floor cutter 340 causes the pan 765, and therefore the shearer 300 supported by the pan 765, to return to zero degrees on the third pass. The historical pan line illustrates the change in pitch angle of the shearer 300 with the number of passes at the pan location. The sequence of FIGS. 15A-C therefore illustrate that the target pitch profiles are only set to the nominal pitch angles plus the correction offsets for the specific number of passes indicated by the correction pass count. Once the correction pass count has been completed, the target pitch angles are set to the nominal pitch angles again.

As described above with reference to FIG. 12, an operator may continuously monitor the position of the shearer 300 to determine whether correction offsets may be needed to maintain an efficient extraction of the mineral and to add those correction offsets to the target pitch profile. Inputting these correction offsets, however, may be prone to human error as the operator relies primarily on a visual inspection of the mineral seam to determine whether the correction offsets are necessary and the value of the correction offset. Accordingly, the controller 384 implements an adaptive method of generating the nominal pitch profiles that reduce the need to manually enter correction offsets to the target pitch profile. In particular, the controller 384 includes the adaptive pitch profile generation module 440 to analyze previous correction offsets input by an operator of the shearer 300 and generate a nominal pitch profile that more closely follows the actual mineral seam, thereby adapting to the changing angles of the coal seam.

Figure 16:
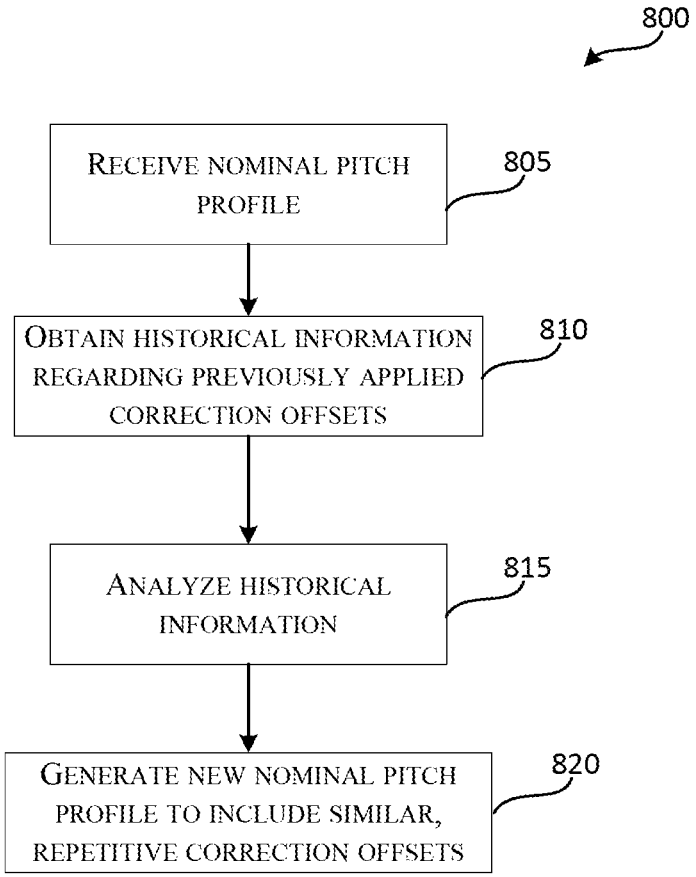
FIG. 16 is a flowchart illustrating a method of generating a target pitch profile.

FIG. 16 illustrates a method 800 of generating a nominal pitch profile by the adaptive pitch profile generation module 440. The method 800 may be used by the electronic processor 430 to implement block 705 of 610 to receive a nominal pitch profile. As shown in FIG. 16, the adaptive pitch profile generation module 440 receives a nominal pitch profile (block 805). In some embodiments, the adaptive pitch profile generation module 440 receives the nominal pitch profile most used from the nominal profile database. In other embodiments, the adaptive pitch profile generation module 440 receives the nominal pitch profile previously used by the target pitch profile generation module 442. The adaptive pitch profile generation module 440 then accesses the historical correction offset database 455 to obtain historical information regarding previously applied correction offsets (block 810). In some embodiments, the adaptive pitch profile generation module 440 accesses the correction offsets for a predetermined number of previous passes by the shearer 300. For example, the adaptive pitch profile generation module 440 accesses the correction offsets for the previous ten passes of the shearer. The predetermined number of previous passes accessed by the adaptive pitch profile generation module 440 may be configurable by a user. In other embodiments, the adaptive pitch profile generation module 440 obtains calculated information regarding the historical correction offsets. For example, the historical correction offset database 455 may calculate and store a running average of the target pitch angles used over the last, for example, ten shearer passes. For example, in some embodiments, the historical correction offset database 455 includes a running average of the target pitch profile used in the last number of shearer passes. In other embodiments, the historical correction offset database 455 only keeps the running average for the portions of the pans that included a correction offset. That is, if sections of the pans have not been corrected in, for example, the last ten shearer passes, the running average may not be stored in the correction offset database 455. It should be understood that while a running average has been described, the correction offset database 455 may, additionally or alternatively, store other statistical measures that provide information regarding the previously requested and applied correction offsets.

The adaptive pitch profile generation module 440 then analyzes the historical information regarding the previously applied correction offsets (block 815). In some embodiments, for example, the adaptive pitch profile generation module 440 analyzes the correction offsets when the shearer 300 is located within the first 25 roof supports. The adaptive pitch profile generation module 440 may then analyze the correction offsets when the shearer 300 is located in the next 25 roof supports, and so on until the adaptive pitch profile generation module 440 analyzes the correction offsets made for the length of the mineral face 216. In some embodiments, for example, when specific correction offsets are stored in the correction offset database 455, the adaptive pitch profile generation module 440 identifies similar correction offsets for the same (or similar) position of the shearer 300 over two or more passes. Two correction offsets may be similar to one another when both correction offsets are offsetting the target profile in the same direction (for example, both increasing the pitch angle). As an example, the adaptive pitch profile generation module 440 may identify that, between the tenth and the fifteenth roof support, a correction offset indicating an increase in the pitch angle was present for seven out of the ten previous shearer passes that were analyzed. As another example, the adaptive pitch profile generation module 440 may identify that, between the first and the fifth roof supports, a correction offset indicating a decrease in the pitch angle was present for three out of the ten previous shearer passes that were analyzed.

The adaptive pitch profile generation module 440 then generates a new nominal pitch profile to include similar, repetitive correction offsets (block 820). For example, to generate the new nominal pitch profile in block 820, the adaptive pitch profile generation module 440 modifies pitch angles of the received nominal pitch profile for future passes of the shearer 300 by applying some of the historical information regarding the correction offsets. In some embodiments, for example, when the historical correction offset database 455 stores the running average of the target pitch profile, generating the new nominal pitch profile may include generating a nominal pitch profile including the running average pitch angles. The nominal pitch profile generated by the adaptive pitch profile generation module 440 is then stored in the nominal profile database and accessed by the target pitch profile generation module 442 as described above with respect to block 705 of FIG. 12.

In some embodiments, the adaptive pitch profile generation module 440 may include a threshold number of similar correction offsets. For example, the adaptive pitch profile generation module 440 may identify a number of similar (repeated) correction offsets (e.g., over a set number of shearer cycles) exceeding the threshold, and may then generate a new nominal pitch profile incorporating the correction offsets. In the example above, the adaptive pitch profile generation module 440 may generate the nominal pitch profile to include the correction offsets that increase the pitch angle between the tenth and the fifteenth roof support (for future passes of the shearer 300) because the correction offsets that increase the pitch angle were included in the majority of the passes that were analyzed and exceeded the threshold number of similar correction offsets. Conversely, the nominal pitch profile is not generated to include the correction offsets that decrease the pitch angle between the first and fifth roof supports because the number of such similar correction offsets does not exceed the threshold. In other embodiments, the adaptive pitch profile generation module 440 may include any correction offsets that were received in more than a single shearer pass. Other thresholds and methods may be implemented by the adaptive pitch profile generation module 440 to determine which correction offsets to incorporate into the nominal pitch profile. By incorporating repetitive correction offsets into a new nominal pitch profile, the adaptive pitch profile generation module 440 builds a more accurate nominal pitch profile that adapts to the changing or mis-estimated pitch angle of the mineral seam and reduces the need for an operator to continuously monitor and correct the pitch angle of the shearer 300 with respect to the mineral seam.

In the illustrated embodiment, the controller 384 generates the new nominal profile based on the correction offsets from previous passes. In other embodiments, however, a different controller generates the new nominal pitch profile. In such embodiments, the controller 384 periodically receives a new nominal profile incorporating correction offsets from previous passes of the shearer 300. In such embodiments, the correction offset database 455 may also be external to the controller 384. In some embodiments, the correction offset database 455 may be remote from the controller 384 and the shearer 300.

Figure 17:
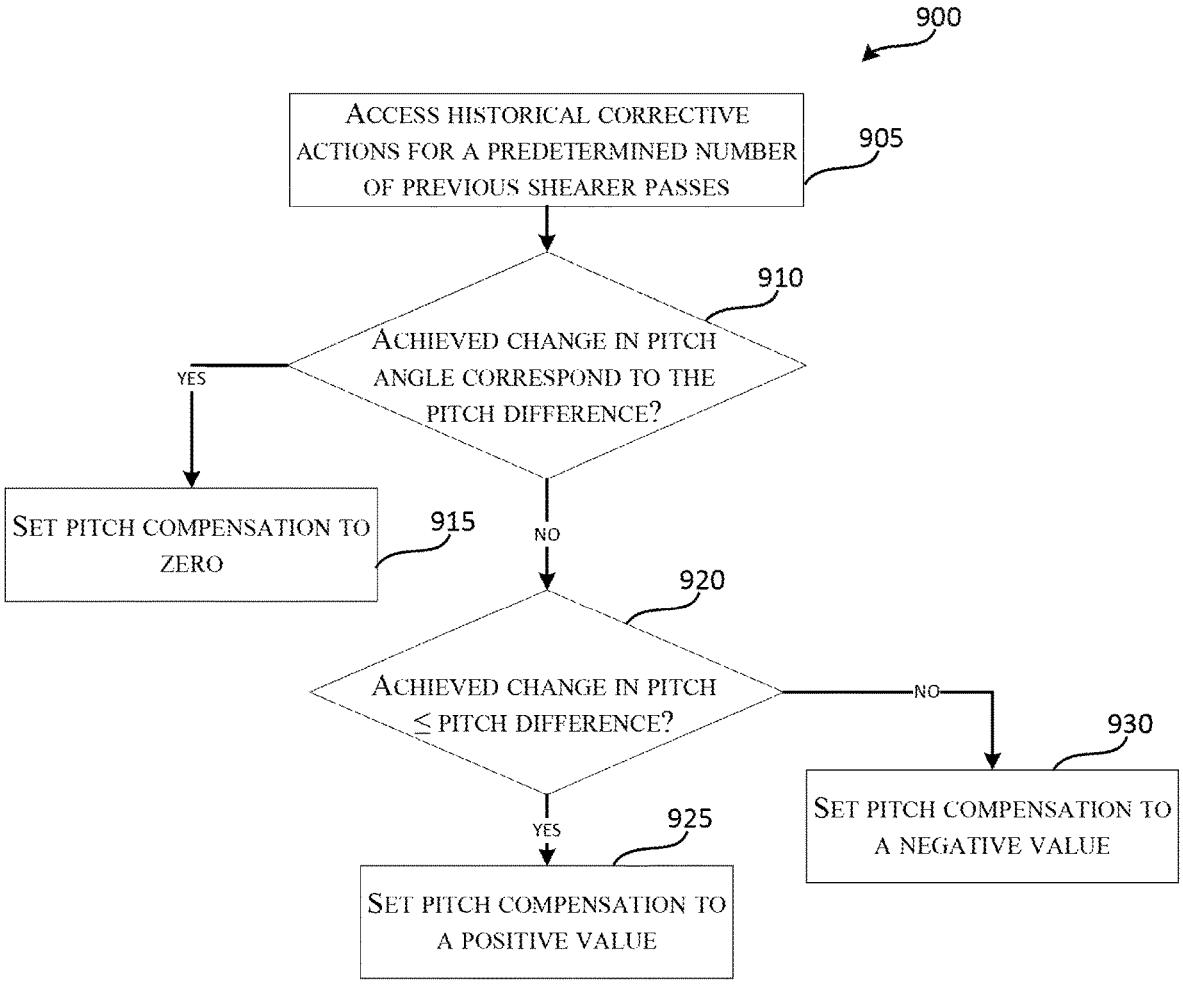
FIG. 17 is a flowchart illustrating a method of generating a pitch compensation value.

Additionally, the controller 384 also analyzes the effectiveness of the pitch correction heights in controlling the pitch angle and generates a pitch compensation value to maintain the effectiveness of the pitch correction heights. For example, different shearers 300 may change pitch angle differently when the same pitch correction height is applied. In another example, different floor conditions cause the shearer 300 to change the pitch angle more or less when the same pitch correction height is applied. FIG. 17 illustrates a method 900 of generating a pitch compensation value by the pitch compensation module 445. The method 900 may be implemented to generate the pitch compensation value that is received by the electronic processor 430 in block 635 of FIG. 11. As shown in FIG. 17, the pitch compensation module 445 accesses historical corrective actions and the achieved changes in pitch angle from the corrective action database 460 for a predetermined number of previous shearer passes (block 905). As discussed above, the corrective action database 460 associates a particular pitch difference (e.g., the difference between the current pitch angle and a target pitch angle), pitch correction height, and achieved change in pitch due to implementing the pitch correction height.

The pitch compensation module 445 then analyzes whether the achieved change in pitch corresponds to the pitch difference (block 910). In other words, the pitch compensation module 445 determines whether the achieved change in pitch is within a predetermined range of the pitch difference. Correspondence between the achieved change in pitch angle and the pitch difference indicates that that the pitch correction height achieved the expected change in pitch. As discussed above, the correction module 438 may implement smoothing (e.g., dividing a larger pitch correction height over several passes instead of implementing the pitch correction height over a single pass). In such embodiments, the pitch difference may correspond to the desired change in pitch in a single pass rather than the difference between the current pitch angle and a target pitch angle.

When the pitch compensation module 445 determines that the achieved change in pitch angle corresponds to the pitch difference, the pitch compensation module 445 assigns a value of zero to the pitch compensation parameter (block 915). The zero value for the pitch compensation parameter indicates that the floor conditions are consistent and provide the expected change in pitch angle from the pitch correction heights. With reference to FIG. 11, when the pitch compensation parameter is set to zero, the correction module 438 determines the pitch correction height based on the pitch difference and without pitch compensation (block 645). On the other hand, when the pitch compensation module 445 determines that the achieved change in pitch angle does not correspond to the pitch difference, the pitch compensation module 445 then determines whether the achieved change in pitch angle is below the pitch difference (block 920). The achieved change in pitch angle is below the pitch difference when the pitch correction height causes a smaller change in pitch angle than the pitch difference. This may occur, for example, when the actual floor conditions are different than those assumed by the correction module 438 when determining the pitch correction height. As an example, floor conditions may change from hard stone floor to soft clay floor causing the same pitch correction height to produce a smaller change in pitch angle.

When the pitch compensation module 445 determines that the achieved change in pitch angle is below the pitch difference, the pitch compensation module 445 sets the pitch compensation to a positive value (block 925). The particular value for the pitch compensation may be based on a difference between the achieved pitch change and the pitch difference. In some embodiments, the pitch compensation value may vary between discrete values such that when the pitch compensation module 445 determines that the achieved change in pitch angle is below the pitch difference the pitch compensation is set to a standard positive value (e.g., +2). When the pitch compensation module 445 determines that the achieved change in pitch angle is not below the pitch difference (i.e., the achieved pitch angle exceeds the pitch difference), the pitch compensation module 445 sets the pitch compensation to a negative value (block 930). As discussed above, the particular values for the pitch compensation may be proportional to the difference between the achieved change in pitch angle and the pitch difference, or may be a standard negative value (e.g., −2). The achieved change in pitch angle exceeds the pitch difference when the pitch correction height causes a larger change in pitch angle than the pitch difference. This may occur, for example, when the floor conditions change from soft clay floor to hard stone floor causing the same pitch correction height to produce a larger change in pitch angle.

As discussed with respect to FIG. 11, the correction module 438 calculates the pitch correction height based on the pitch difference and the non-zero pitch compensation value (block 640). Generating the pitch compensation value and using the pitch compensation to calculate the pitch correction height allows the controller 384 to adaptively control the pitch angle of the shearer 300 under different floor conditions. In other words, by recording and analyzing the pitch correction heights and the achieved change in pitch angle, the controller 384 can determine the effectiveness of the pitch correction heights in achieving a target pitch angle. In this manner, when the controller 384 determines that the pitch correction heights are not achieving the target pitch angle, the controller 384 can adequately adapt by considering also the pitch compensation value when determining the pitch correction height of the floor cutter 340. Accordingly, the controller 384 can automatically adapt to changing floor conditions.

In the illustrated embodiment, the controller 384 sets the value of the pitch compensation based on the corrective actions from previous passes. In other embodiments, however, a different controller sets the value for the pitch compensation. In such embodiments, the controller 384 periodically receives a pitch compensation value to determine the pitch correction height. In such embodiments, the corrective action database 460 may also be external to the controller 384. In some embodiments, the corrective action database 460 may be remote from the controller 384 and the shearer 300.

Figure 18:
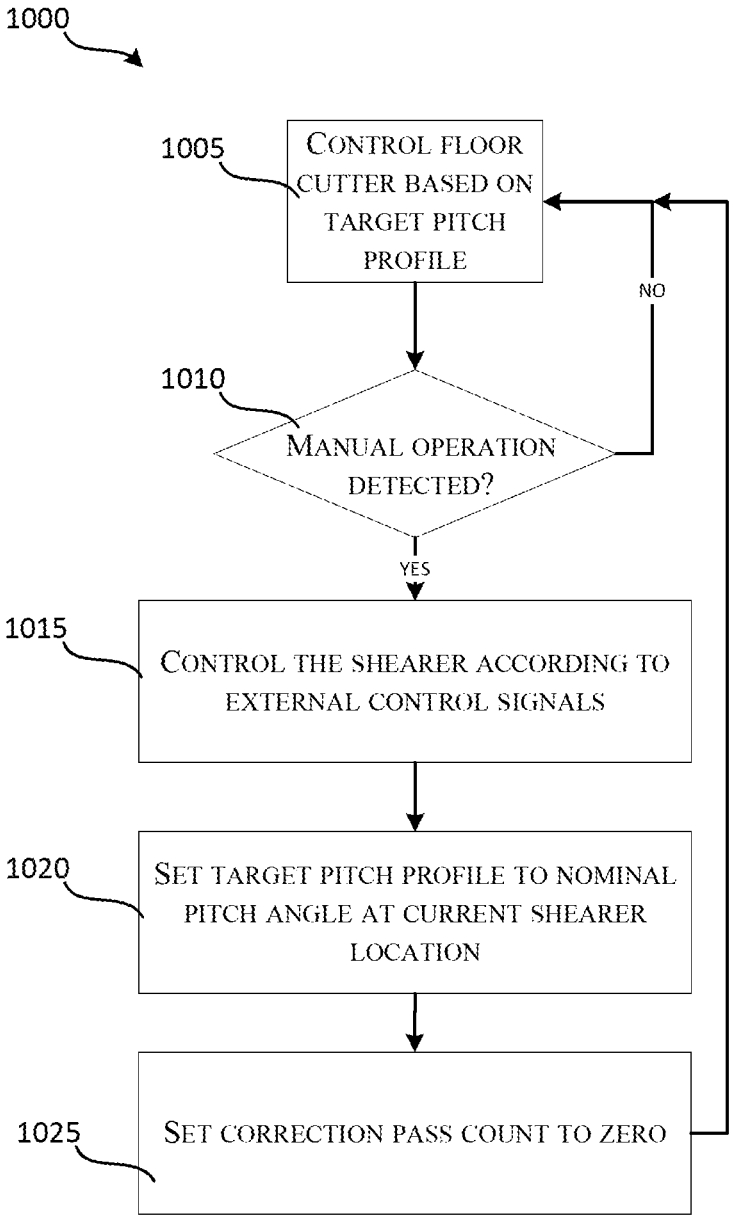
FIG. 18 is a flowchart illustrating a method of manually controlling the shearer.

As discussed above, the target pitch profile includes the target pitch angles taking into account the correction offsets received from the operator. In some instances, however, an operator may observe that even adapting the target pitch profile does not generate the desired change in the position of the shearer 300 (e.g., by inputting correction offsets). The longwall system 200, and the controller 384 in particular, therefore allow an operator to manually control the shearer 300. FIG. 18 illustrates a method 1000 of operating the shearer 300 in a manual mode. As shown in FIG. 18, the controller 384 monitors and controls the shearer 300 based on the target pitch profile (block 1005). For example, to implement block 1005, the controller 384 implements the method 600 of FIG. 11. The controller 384 then determines whether manual operation is detected (block 1010). The controller 384 may detect manual operation by, for example, receiving a user input indicating that manual operation is desired (for example, by activating a manual operation actuator). In some embodiments, the controller 384 may detect manual operation is desired when the controller receives control signals from an external device (for example, the controller 384 receives control signals indicating that the floor cutter 340 should lower). The external device may be, for example, a portable wireless device that generates a graphical interface allowing the user to provide control signals to the controller 384. While the controller 384 does not detect manual operation of the shearer 300, the controller 384 (in particular, the analysis module 434) continues to control the shearer 300 based on the target pitch profile (block 1005).

On the other hand, when manual operation is detected, the manual operation module 446 controls the shearer according to external control signals (block 1015). The manual operation module 446 also resets the target pitch angle to the nominal pitch angle while the manual operation module 446 receives the external control signals (block 1020). For example, if manual operation is activated between the fifth pan and the twentieth pan, the controller resets the target pitch angles between the fifth pan and the twentieth pan to the nominal pitch angles corresponding to the same pans. By resetting the target pitch profile to the nominal pitch angle values while manual operation is enabled, the target pitch profile no longer takes into account any preprogrammed correction offsets (if any) during that portion of the mineral face 216. Accordingly, the manual operation module 446 also resets the correction pass count for the relevant pans to zero (since the target pitch angle for the relevant portion of the mineral face corresponds to the nominal pitch angle for the same portion) at block 1025. The controller 384 then returns to block 1005 to control the pitch angle based on the target pitch profile.

Figure 19:
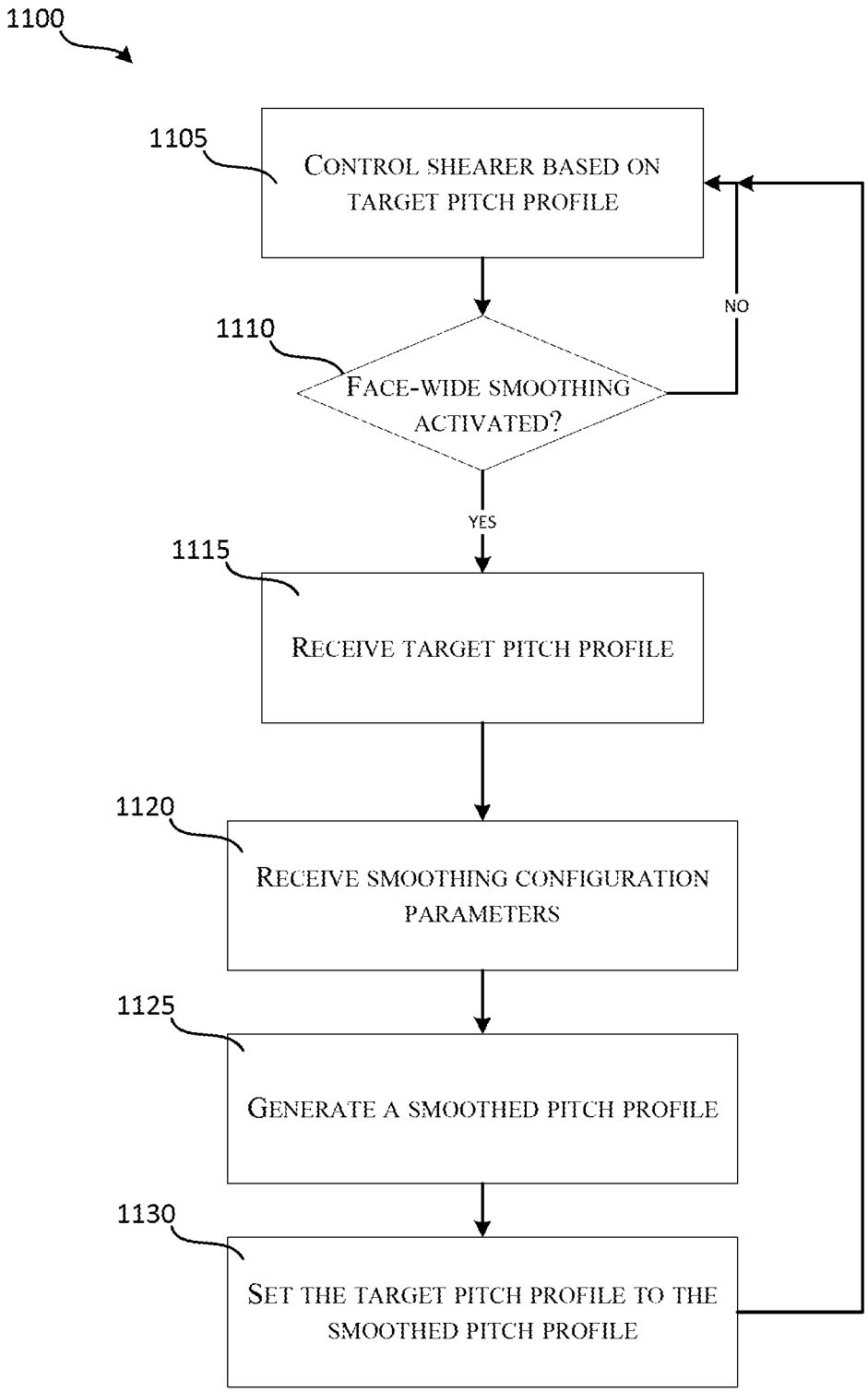
FIG. 19 is a flowchart illustrating a method of smoothing the target pitch profile.

Referring back to FIG. 10, the controller 384 also includes a face-wide smoothing module 448 that ensures that the pitch angles do not change drastically as the shearer 300 travels along the AFC 215. FIG. 19 illustrates a method 1100 of smoothing the target pitch profile. As shown in FIG. 19, the controller 384 controls the shearer 300 based on the target pitch profile (block 1105). For example, to implement block 1105, the controller 384 implements the method 600 of FIG. 11. The controller 384 then determines whether face wide smoothing is activated (block 1110). In some embodiments, face wide smoothing of the target pitch profile is activated (e.g., triggered) when the shearer 300 changes travel direction (e.g., when the shearer 300 switches from traveling toward the maingate to traveling toward the tailgate). In other embodiments, face wide smoothing may be activated by an operator, for example, by activating an actuator, issuing a voice command, or the like. In some embodiments, face wide smoothing is set to be activated by default and may require a user input to become deactivated. In yet other embodiments, other movements or positions of the shearer 300 trigger face-wide smoothing of the target profile. In some embodiments, the face-wide smoothing may be activated periodically, for example, every 45 minutes.

When the controller 384 determines that face-wide smoothing is not yet activated, the controller 384 continues to monitor the shearer 300 based on the target pitch profile (block 1105). On the other hand, when the controller 384 determines that face-wide smoothing is activated, the face-wide smoothing module 448 receives the target pitch profile (block 1115) and the smoothing configuration parameters (block 1120). These smoothing configuration parameters may be the same or different than those used by the correction smoothing module 444. The smoothing correction parameters may establish, for example, minimum or maximum pitch angle thresholds, functions to smooth the pitch angles, and the like. The face-wide smoothing module 448 then generates a smoothed pitch profile (block 1125). The face-wide smoothing module 448 generates the smoothed pitch profile by analyzing the change in pitch angles for the length of the target pitch profile. In some embodiments, the face-wide smoothing module calculates the changes in pitch over a predetermined lateral distance (for example, 5 pans). When the face-wide smoothing module 448 determines that the calculated change in pitch exceeds a high pitch change threshold, the face-wide smoothing module 448 determines that the change in pitch is to be smoothed over additional pans. The number of additional pans needed to provide a smooth transition to the higher pitch angle may depend on the difference between the calculated change in pitch and the high pitch change threshold. Accordingly, in some embodiments, the face-wide smoothing module 448 may calculate a difference between the calculated change in pitch over the predetermined number of pans and the high pitch change threshold to determine the number of additional pans needed to smooth the target pitch profile. When generating the smoothed pitch profile, the face-wide smoothing module may perform similar steps as those described with respect to block 745, 750, and 755 of FIG. 12. That is, the face-wide smoothing module may determine the start and end points to be used for the gradual ramps, and then calculate the pitch angles to form the gradual ramp. After the face-wide smoothing module 448 generates the smoothed pitch profile, the face-wide smoothing module 448 sets the target pitch profile to the smoothed pitch profile to inhibit drastic changes in pitch angle as the shearer 300 travels along the AFC 215. The controller 384 then returns to block 1105 to control the pitch angle based on the target pitch profile.

Although the steps in FIGS. 11, 12, and 16-19 are shown as occurring serially, one or more of the steps may be executed simultaneously. For example, some of the comparison steps of FIGS. 11, 12, and 16-19 may occur simultaneously such that all conditions are checked. Therefore, the controller 384 adapts its control of the pitch angle of the shearer 300 based on historical data of corrective actions and correction offsets. The controller 384 then assists in the shearer 300 avoiding operation at undesirable pitch angles and provides corrective action to automatically change the position of the floor cutter 340 to impact the pitch angle of the shearer 300. The controller 384 may also monitor and control other operations and/or characteristics of the shearer 300, such as, for example, the speed of the cutters 335, 340, the roll angle, the position of the cutters 335, 340 independent of the pitch of the shearer 300, and the like.

Additionally, in some embodiments, one or more steps in FIGS. 11, 12, and 16-19 are bypassed. For example, in some embodiments of method 600, the pitch compensation value is not used and, accordingly, block 635 is bypassed, and the pitch correction height calculated in block 640 is not based on the pitch compensation value. As another example, in some embodiments of method 700, the correction offsets are not implemented and, accordingly, blocks 720-760 are bypassed. As yet another example, in some embodiments, one or both of the storage blocks 650 of method 600 and 735 of method 700 are bypassed and the associated historical data is not used in the method 600.

With reference to the comparisons discussed with respect to FIGS. 11, 12, and 16-19, "exceeding" means greater than, or means greater than or equal to, and "below" means less than, or means less than or equal to.

While the controller 384 monitors and controls the position of the floor cutter drum 384 based on the target pitch profile in the pitch steering mode, the controller 384 may control the roof cutter drum 335 in various modes. For example, in the illustrated embodiments, the controller 384 controls the roof cutter drum 335 in a manual mode, a pre-defined height mode, or a recorded mode based on a received selection from an operator. The operator may select the mode of operation for the roof cutter drum 335 based on, for example, the geology of the mine site, the size of the mineral seam, and the like. In some embodiments, the operator may activate an actuator to select the operating mode for the roof cutter drum 335.

When the roof cutter drum 335 operates in the manual mode, the controller 384 controls the position of the roof cutter drum 335 based on external control signals. The external control signals are generated by an operator via, for example, a portable wireless device. In other embodiments, the operator may generate the external control signals using a different device. The external control signals indicate to the controller 384 the desired position for the roof cutter drum 335. In some embodiments, the controller 384 still implements limits on the vertical range of movement of the roof cutter drum 335 to inhibit the shearer 300 from over-extracting and/or under-extracting. When the roof cutter drum 335 operates in the pre-defined height mode, the controller 384 positions the roof cutter drum 335 based on a target cutting profile. For example, in some embodiments, an initial cutting sequence (e.g., a pass along the mineral face 216) and a height for the roof cutter drum 335 are defined by use of an offline software utility, which is then loaded on to the controller 384 as a cutting profile. Once the shearer controller 384 has access to the initial cutting sequence and the heights for the roof cutter drum 335, the controller 384 controls the roof cutter drum 335 such that the roof cutter drum 335 automatically replicates the pre-defined cutting profile until conditions in the mineral seam 217 change. When seam conditions change, an operator of the shearer 300 may override control of one of the roof cutter drum 335 and implement, for example, manual control of the roof cutter drum 335. The operator may input corrections to the cutting profile and accordingly change the height of the roof cutter drum 335.

Additionally, the cutting profile may define different cutter heights for different sections along the mineral face 216. For reference purposes, the mineral face 216 may be divided up into sections based on roof supports. For a simple example, the longwall system may include one hundred roof supports along the mineral face 216, and the cutting profile for a single shearer pass may specify cutter heights every ten roof supports. In this example, ten different cutter heights, one for each section of ten roof supports, would be included in a cutting profile for a single shearer pass to define the cutter heights for the entire wall. The size of the sections (i.e., the number of roof supports per section) may vary depending on the desired precision and other factors.

The recorded height mode includes an automatic recorded sub-mode and an override recorded sub-mode. While the roof cutter drum 335 is controlled in the override recorded sub-mode, the controller 384 controls the position of the roof cutter drum 335 based on external control signals received from the operator, and records the position of the roof cutter drum 335 as a recorded cutting profile. The controller 384 then switches from the override recorded sub-mode to the automatic recorded sub-mode to implement the recorded cutting profile. That is, during the automatic recorded sub-mode, the controller 384 controls the roof cutter drum 335 according to the newly recorded cutting profile. When operating in the recorded height mode, the roof cutter drum 335 and the floor cutter drum 340 are not referenced to each other (that is, the height of the roof cutter drum 335 is measured as an absolute height (e.g., with respect to the pan or central housing 365 of the shearer 300), rather than a height from the floor cutter drum 340), which may be the case in other operating modes of the longwall system 200. Accordingly, while the controller 384 controls the roof cutter drum 335 based on the recorded height mode, the controller 384 may calculate a vertical distance between the roof cutter drum 335 and the floor cutter drum 340 (e.g., an extraction distance), compare the calculated extraction distance to a maximum extraction height threshold, and compare the calculated extraction distance to a minimum extraction height threshold. When the calculated extraction height exceeds the maximum extraction height threshold and/or when the calculated extraction height is below the minimum extraction height threshold, the controller 384 generates an alert. The alert may be displayed to the operator, for example, via an e-mail as described below. The alert may alternatively be transmitted to the operator differently.

Additionally, although FIGS. 11, 12, and 16-19 have been described as changing the position of the floor cutter drum 340 to achieve a target pitch angle, in some embodiments, the roof cutter drum 335 may be controlled based on the pitch of the shearer 300 and the controller may adjust the height of the roof cutter drum 335 according to the pitch of the shearer 300. In some embodiments, the controller 384 performs similar steps as those described with respect to FIGS. 11-19, except with respect to the roof cutter drum 335. By changing the height of the roof cutter drum 335, the material sheared by the shearer also changes and may better align with previous passes of the shearer 300.

Figure 20:
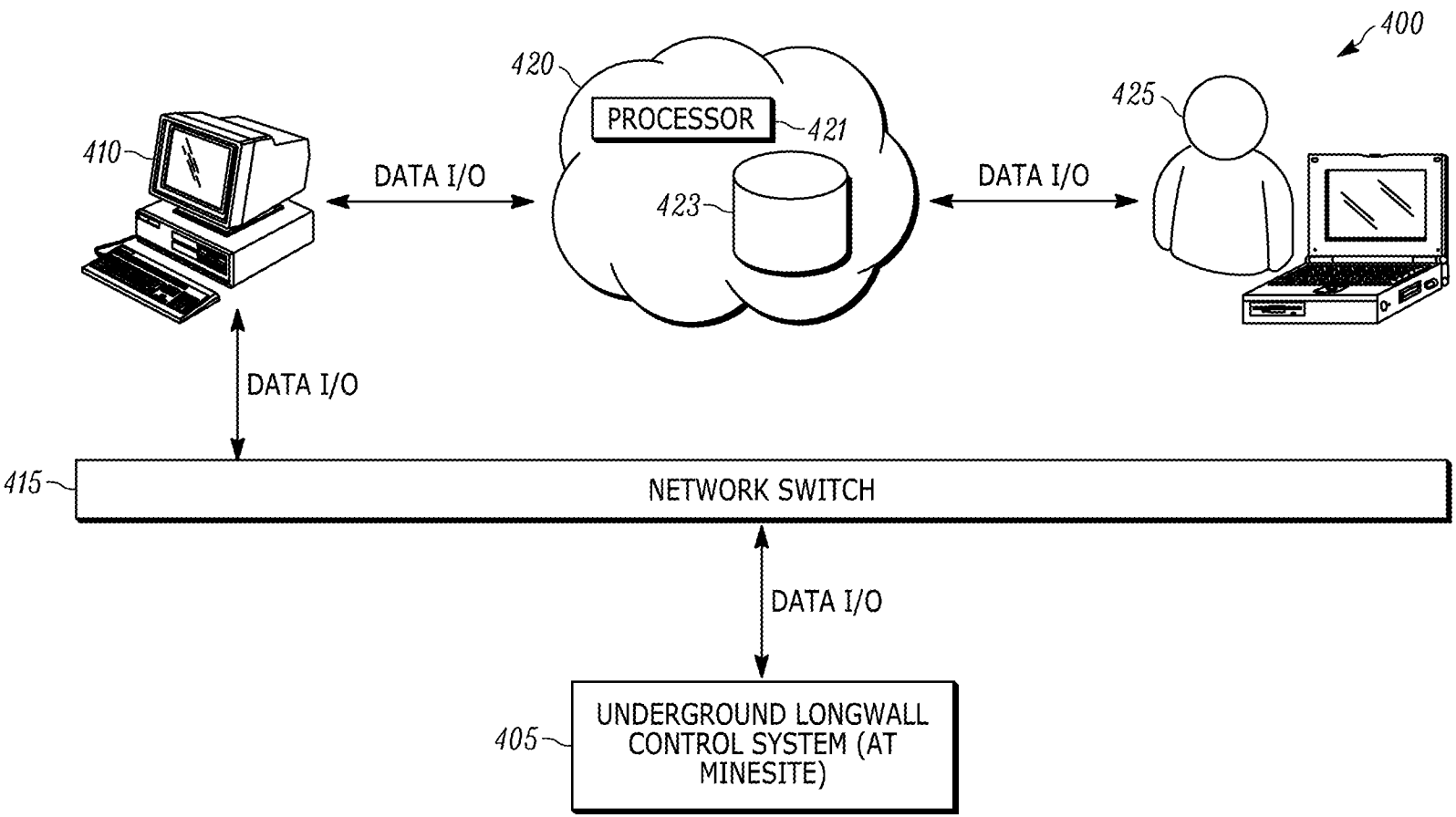
FIG. 20 is a schematic diagram of a health monitoring system of the extraction system shown in FIG. 1.
Figure 21:
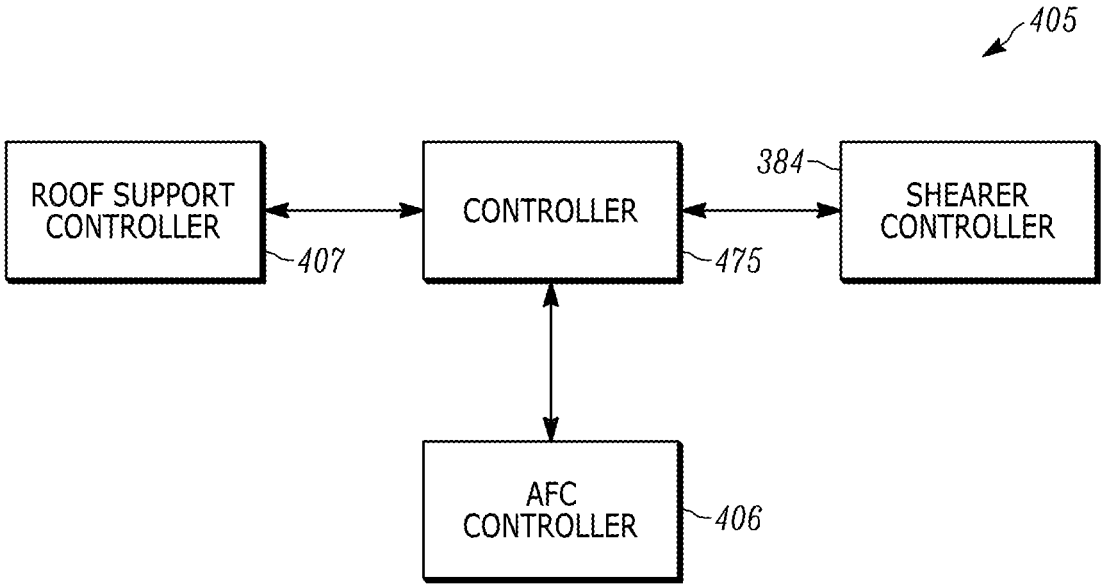
FIG. 21 is a schematic diagram of the longwall control system of the health monitoring system of FIG. 20.

The extraction system 100 also includes a health monitoring system 400 that monitors general operation of the longwall system 200. As shown in FIG. 20, the health monitoring system 400 includes longwall control system 405, a surface computer 410, a network switch 415, a monitoring system 420, and a service center 425. In the illustrated embodiment, the longwall control systems 405 are located at the mine site. The longwall control system 405 includes various components and controls for the components of the longwall mining system 200. For example, the longwall control system 405 may include various components and controls for the shearer 300, the roof supports 205, the AFC 215, and the like. As shown in FIG. 21, the longwall control systems 405 include a main controller 475 configured to be in communication with the shearer controller 384, an AFC controller 406, and a roof support controller 407. In other embodiments, the longwall control systems 405 are configured such that the main controller 475 communicates directly with sensors and systems relevant to the AFC 215, the roof support 205, and the shearer 300. In such embodiments, the shearer controller 384 may be omitted and the sensors 360, 365, 370, 375, 380, the hydraulic systems 386, 388, and the cutter motors 350, 355 communicate directly with the main controller 475.

As shown in FIG. 20, the longwall control systems 405 are in communication with the surface computer 410 via the network switch 415, both of which can also be located at the mine site. Data from the longwall control system 405 is communicated to the surface computer 410, such that, for example, the network switch 415 receives and routes data from the controller 475 and/or the individual control systems of the shearer 300, the roof supports 205, and the AFC 215. The surface computer 410 is in further communication with a remote monitoring system 420, which can include various computing devices and processors 421 for processing data received from the surface computer 410 (such as the data communicated between the surface computer 410 and the various longwall control systems 405), as well as various servers 423 or databases for storing such data. The remote monitoring system 420 processes and archives the data from the surface computer 410 based on control logic that can be executed by one or more computing devices or processors 421 of the remote monitoring system 420. The particular control logic executed at the remote monitoring system 420 can include various methods for processing data from each mining system component (i.e., the roof supports 205, the AFC 215, shearer 300, and the like). The remote monitoring system 420 applies stored rules and algorithms to the data received from the surface computer 410 to determine if the longwall system 200 operates within specified parameters. If the remote monitoring system 420 determines that the longwall system 200 does not operate within specified parameters, the remote monitoring system 420 may flag the occurrence as an event and generate an alert. In some embodiments, the remote monitoring system 420 may communicate with the service center 425 to notify the service center 425 of the operation of the longwall system 200. A user can also contact the service center 425 directly to inquire about a specific longwall system 200.

Each of the components of the health monitoring system 400 is communicatively coupled for bi-directional communication. The communication paths between any two components of the health monitoring system 400 may be wired (e.g., via Ethernet cables or otherwise), wireless (e.g., via a WiFi®, cellular, Bluetooth® protocols), or a combination thereof. Although only an underground longwall mining system 200 and a single network switch 415 is depicted in FIG. 20, additional mining machines both underground and surface-related (and alternative to longwall mining) may be coupled to the surface computer 410 via the network switch 415. Similarly, additional network switches 415 or connections may be included to provide alternate communication paths between the underground longwall control systems 405 and the surface computer 410, as well as other systems. Furthermore, additional surface computers 410, remote monitoring systems 420, and service centers 425 may be included in the health monitoring system 400.

As explained above, the controller 475 receives information regarding the various components of the longwall mining system 200. The controller 475 can aggregate the received data and store the aggregated data in a memory, including a memory dedicated to the controller 475. Periodically, the aggregated data is output as a data file via the network switch 415 to the surface computer 410. From the surface computer 410, the data is communicated to the remote monitoring system 420, where the data is processed and stored according to control logic particular for analyzing data aggregated since the previous data file was sent. The aggregated data may also be time-stamped based on the time the sensors 360, 365, 370, 375, 380 and other sensors from the longwall system 200 obtained the data. The data can then be organized based on the time it was obtained. For example, a new data file with sensor data may be sent every three minutes. The data file includes sensor data aggregated over the previous three minute window. In some embodiments, the time window for aggregating data can corresponds to the time required to complete one shearer cycle. In some embodiments, the controller 475 does not aggregate data, but rather the controller 475 sends data as it is received in real-time. In such embodiments, the remote monitoring system 420 is configured to aggregate the data as it is received from the controller 475. The remote monitoring system 420 can then analyze the shearer data based on stored aggregated data, or based on horizon control data received in real-time from the controller 475.

Figure 22:
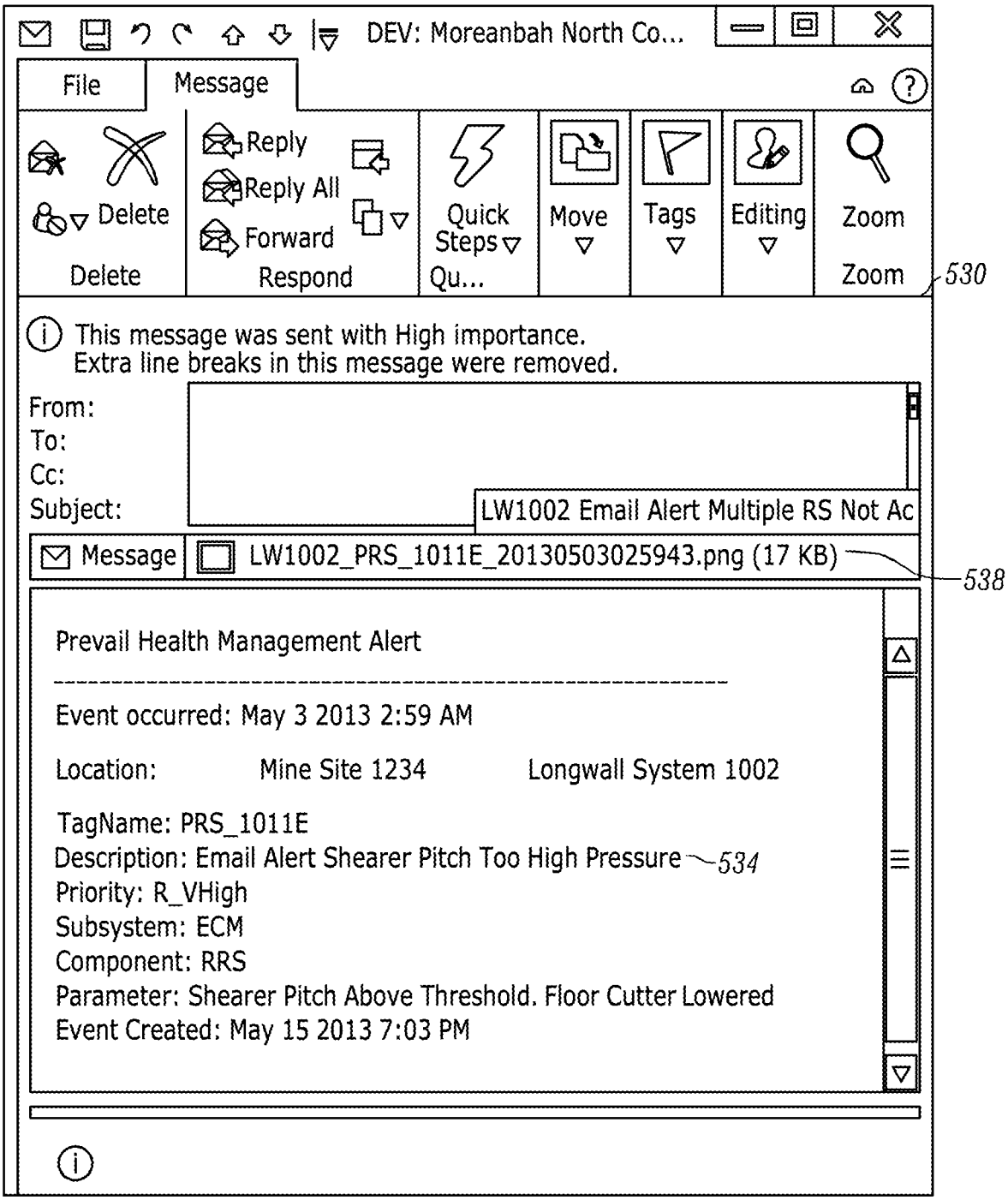
FIG. 22 illustrates an exemplary e-mail alert.

In some embodiments, the remote monitoring system 420, in particular the remote processor 421, also generates an alert or alarm when the shearer 300 operates outside of specified parameters. For example, the alarm or alert may include general information about the event including, for example, when the event occurred, a location of the event, an indication of the parameter associated with the event (e.g., shearer pitch angle and floor cutter position), and when the event/alert was created. The alert can be archived in the remote monitoring system 420 or exported to the service center 425 or elsewhere. For example, the remote monitoring system 420 can archive alerts that are later exported for reporting purposes. The alert may take several forms (e.g., e-mail, SMS messaging, etc.). In the illustrated embodiment, the alert is an e-mail message as shown in FIG. 22. In the illustrated embodiment, the e-mail alert 530 includes text 534 with general information about the alert. In some embodiments, the e-mail alert 530 may also include an attached image file 538. In the illustrated embodiment, the attached image file 538 is a Portable Network Graphic (.png) file, including a graphic depiction of the operation of the shearer 300 as the shearer 300 shears mineral from the mineral face 216.

It should be understood that while the controller 384 of the shearer 300 was described as performing the functionality with regard to monitoring the pitch position of the shearer 300, in some embodiments, the health monitoring system 400 monitors the pitch position of the shearer 300 and sends instructions to the shearer 384 regarding the change in position of the floor cutter 340. In such embodiments, the controller 384 of the shearer 300 may serve to route information to the longwall control system 405 and then to the remote monitoring processor 421. The remote monitoring processor 421 then executes the method shown in FIG. 11, and sends instructions back to the controller 384 to change the position of the floor cutter 340 in a specified manner.

In yet other embodiments, the longwall controller 475 performs the monitoring of the pitch position of the shearer 300. Again, in such embodiments, the controller 384 of the shearer 300 routes data from the sensors 360, 365, 370, 375, 380 to the longwall controller 475. The longwall controller 475 determines the corrective action (i.e., if the position of the floor cutter 340 needs to change) and sends instructions to the controller 384 of the shearer 300 to change the position of the floor cutter 340, if needed. In yet other embodiments, the controller 384 of the shearer 300 may be omitted, and the health monitoring system 400, for example, the longwall controller 475, the remote monitoring processor 421, or a combination thereof, monitor the pitch position of the shearer as described with respect to FIGS. 11-19.

It should also be noted that the remote monitoring system 420 may run analyses described with respect to the pitch angle, as well as other analyses, whether these analyses are conducted on horizon data or other longwall component system data. The analyses can be executed by either the processor 421 or another designated processor of the health monitoring system 400. For example the remote monitoring system 420 may run analyses on monitored parameters (collected data) from other components of the longwall mining system 200. In some instances, for example, the remote monitoring system 420 performs other analyses on data collected form the sensors 360, 365, 370, 375, 380 and generates alerts. Such alerts can include detailed information regarding a situation that triggers the alert.

Thus, the invention provides, among other things, systems and method for monitoring the pitch angle of a shearer in a longwall mining system. Various features and advantages of the invention are set forth in the following claims.

What is claimed is:

1. A method of controlling a pitch angle of a shearer, the method comprising:

storing in a memory, as historical corrective actions, for one or more previous shearer passes, a previous pitch correction height, a previous pitch difference, and a previous achieved change in pitch angle resulting from changing a height of a floor cutter of the shearer based on the previous pitch correction height;

receiving a sensor signal indicative of the pitch angle of the shearer;

receiving a target pitch profile defining a plurality of target pitch angles for different sections of a mineral face;

determining, with an electronic processor, a pitch difference between the pitch angle and a target pitch angle of the plurality of target pitch angles of the target pitch profile;

determining a pitch compensation value based on the historical corrective actions;

determining, with the electronic processor, a pitch correction height corresponding to a new height for the floor cutter based on the pitch difference and pitch compensation value; and changing, with the electronic processor, a height of the floor cutter based on the pitch correction height.

2. The method of claim 1, wherein determining the pitch correction height includes calculating the pitch correction height by translating the pitch difference to a change in vertical position of the floor cutter and adding the pitch compensation value to determine a target vertical position of the floor cutter.

3. The method of claim 1, further comprising: determining the target pitch angle from the target pitch profile based on a current lateral position of the floor cutter.

4. The method of claim 1, further comprising: determining the height of the floor cutter based on the sensor signal.

5. The method of claim 1, further comprising:

receiving smoothing configuration parameters; and generating the target pitch profile based on an initial target pitch profile and the smoothing configuration parameters such that the plurality of target pitch angles for different sections of a mineral face are smoothed.

6. The method of claim 1, further comprising:

receiving a nominal pitch profile for the shearer, accessing a correction offset input by an external source for a section of the mineral face, and generating the target pitch profile based on the nominal pitch profile and the correction offset.

7. The method of claim 6, further comprising:

determining a correction pass count for the correction offset; and in response to determining a number of shearer passes since the correction offset has reached a correction pass count, setting the target pitch angle for the section of the mineral face to the nominal pitch profile.

8. A system of controlling a pitch angle of a shearer, the system comprising:

a shearer sensor configured to sense a position characteristic of the shearer;

a floor cutter driven by a cutter motor; and a controller coupled to the shearer sensor and the cutter motor, and including an electronic processor and a memory, the electronic processor configured to store in the memory, as historical corrective actions, for one or more previous shearer passes, a previous pitch correction height, a previous pitch difference, and a previous achieved change in pitch angle resulting from changing a height of the floor cutter of the shearer based on the previous pitch correction height, receive a sensor signal from the shearer sensor indicative of the pitch angle of the shearer, receive a target pitch profile defining a plurality of target pitch angles for different sections of a mineral face, determine a pitch difference between the pitch angle and a target pitch angle of the plurality of target pitch angles of the target pitch profile, determine a pitch compensation value based on the historical corrective actions, determine a pitch correction height corresponding to a new height for a floor cutter of the shearer based on the pitch difference and the pitch compensation, and change the height of the floor cutter based on the pitch correction height.

9. The system of claim 8, wherein determining the pitch correction height includes calculating the pitch correction height by translating the pitch difference to a change in vertical position of the floor cutter and adding the pitch compensation value to determine a target vertical position of the floor cutter.

10. The system of claim 8, wherein the electronic processor is further configured to: determine the target pitch angle from the target pitch profile based on a current lateral position of the floor cutter.

11. The system of claim 8, wherein the electronic processor is further configured to: determine the height of the floor cutter based on the sensor signal.

12. The system of claim 8, wherein the electronic processor is further configured to:

receive smoothing configuration parameters; and generate the target pitch profile based on an initial target pitch profile and the smoothing configuration parameters such that the plurality of target pitch angles for different sections of a mineral face are smoothed.

13. The system of claim 8, wherein the electronic processor is further configured to:

receive a nominal pitch profile for the shearer, access a correction offset input by an external source for a section of the mineral face, and generate the target pitch profile based on the nominal pitch profile and the correction offset.

14. The system of claim 13, wherein the electronic processor is further configured to:

determine a correction pass count for the correction offset; and in response to determining a number of shearer passes since the correction offset has reached a correction pass count, set the target pitch angle for the section of the mineral face to the nominal pitch profile.

* * * * *